US007351522B2

(12) United States Patent
Yoshida

(10) Patent No.: US 7,351,522 B2
(45) Date of Patent: Apr. 1, 2008

(54) CONCENTRATED PROCESSING COMPOSITION FOR SILVER HALIDE COLOR PAPER AND METHOD OF PROCESSING

(75) Inventor: Kazuaki Yoshida, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/660,336

(22) PCT Filed: Aug. 15, 2005

(86) PCT No.: PCT/JP2005/014927

§ 371 (c)(1),
(2), (4) Date: Feb. 15, 2007

(87) PCT Pub. No.: WO2006/019084

PCT Pub. Date: Feb. 23, 2006

(65) Prior Publication Data

US 2007/0269753 A1 Nov. 22, 2007

(30) Foreign Application Priority Data

Aug. 20, 2004 (JP) ..... 2004-240554

(51) Int. Cl.
*G03C 1/42* (2006.01)

(52) U.S. Cl. ..... 430/498; 430/400; 430/430; 430/449; 430/460; 430/398; 430/401; 430/455; 430/458

(58) Field of Classification Search ..... 430/400, 430/430, 449, 460, 398, 401, 455, 458, 498
See application file for complete search history.

(56) References Cited

U.S. PATENT DOCUMENTS 5,006,456 A 4/1991 Morigaki et al.
5,204,228 A 4/1993 Yoshimoto et al.
6,174,653 B1 1/2001 Wildman et al.
7,135,275 B2 * 11/2006 Yoshida ..... 430/458

FOREIGN PATENT DOCUMENTS

| | | | |
|---|---|---|---|
| JP | 1-230039 | A | 9/1989 |
| JP | 4-118650 | A | 4/1992 |
| JP | 7-234488 | A | 9/1995 |
| JP | 9-54408 | A | 2/1997 |
| JP | 9-160196 | A | 6/1997 |
| JP | 9-166854 | A | 6/1997 |
| JP | 2000-122246 | A | 4/2000 |
| JP | 2004-53921 | A | 2/2004 |

* cited by examiner

*Primary Examiner*—Geraldina Visconti
(74) *Attorney, Agent, or Firm*—Birch, Stewart, Kolasch & Birch, LLP

(57) ABSTRACT

An object of the present invention is to provide a method of processing silver halide color paper that ensures (a) promptness such that finished prints can be handed at shop to customers, (b) small installation area for mini-labs, (c) processing solution stability capable of withstanding slack seasons, (d) normal image quality, (e) small replenishment solution amount and (f) inhibition of tar generation and sulfuration phenomenon occurrence. This object can be attained by a concentrated processing composition for color paper which has a concentrated processing composition for bleach replenishment of 3.0 or less in pH containing 0.3 mol/L or more of EDTA.Fe(III) ammonium, 0.3 mol/L or more of a sulfinic acid compound of specified structure and 0.5 mol/L or more of ammonium bromide and a concentrated processing composition for fixative replenishment of 4.0 or more in pH containing 0.7 mol/L of ammonium thiosulfate and 0.4 mol/L or more of ammonium sulfite, and which is used in a processing involving the steps of treatment in a color developer, bleaching treatment and fixing treatment, and a processing method using the concentrated processing composition for color paper.

6 Claims, 2 Drawing Sheets

CONCENTRATED PROCESSING COMPOSITION FOR SILVER HALIDE COLOR PAPER AND METHOD OF PROCESSING

TECHNICAL FIELD

The present invention relates to a method of processing silver halide color paper (hereinafter sometimes described merely as color paper) and, particularly, to a space-saving processing method which permits short-time processing with keeping quality of finished prints obtained by processing color paper according to the method and keeping processing adaptability of photographic processing solutions.

BACKGROUND ART

In recent years, there has prevailed a business model wherein an automatic development processor that performs processing of photographic light-sensitive materials, called a mini-lab, is set up at a shop front for a quick service for general users in place of collection and delivery between a photograph shop and a processing laboratory. Mini-labs are required to perform quick processing so that a customer having brought a photographed light-sensitive material can receive a finished print on the spot without visiting the shop again. Particularly, in recent years, since photographing media which are the objects required to be printed into color prints have included electronic image recording media photographed in a digital camera as well as silver salt photographic films, it becomes more necessary than ever to provide a service that gives a "convenient and quick" feel so as to render new customers to become familiar with the shop.

In order to give the "convenient and quick" feel, color copying methods such as an ink jet method, a thermally dye-transferring method and a color electrostatic photographic method are suitable but, since they fail to give pictorial image quality, customers who satisfy the images are limited, and excellent image quality that color prints have has been desired.

As print-producing means to be employed in mini-labs that can provide both image quality and convenience/quickness, there has been proposed a thermally developing color diffusion transfer method (trade name: Picto Color), and image-forming materials for the method and print-producing techniques are explained in, for example, non-patent document 1. However, this method involves a disadvantage in the point that an unnecessary product called a donor film produced in the course of producing color prints must be discarded.

On the other hand, there has been made an invention of using color paper excellent in image quality and processing it in a simple and rapid manner. For example, patent document 1 discloses a processing period-shortening processing which uses a light-sensitive material containing a specific magenta coupler, and in which the light-sensitive material is treated in a color developer containing a nitrogen-containing hetero ring compound, subjected to bleach-fixing treatment, and subjected to rinsing treatment, with an example being illustrated wherein the time for the silver-removing step is 15 seconds, and the time for total dipping steps is 53 seconds. However, objects of this processing are limited to light-sensitive materials containing a specific coupler, and hence the processing is limited as to its application scope and, in addition, the processing involves a problem that, when formulation of a bleach-fixing solution varies in a direction that its silver-removing activity is deteriorated in a rapid processing, there arises insufficient silver removal. Also, with acceleration of processing, the processing has defects essential to a bleach-fixing solution that the minimum yellow density is increased, that stain with time of a treated light-sensitive material is increased due to insufficient removal of a residual developing agent by washing and that precipitation occurs in a running solution for bleaching and in the concentrated solution.

Also, it is described in patent document 2 that a bleach-fixing composition comprising a low-pH bleaching agent part containing iron (III) aminopolycarboxylate complex salt and a non-chelation type aminopolycarboxylic acid and a high-pH fixing composition part can suppress generation of a precipitate with time (Fe(II) complex salt) and can reduce the amount of a replenisher and/or accelerate the bleach-fixing processing, and it is shown therein as an Example that a markedly shortened processing of 16 seconds in a silver-removing step and 48 seconds in the total dipping steps is possible by employing a method of adding individual parts directly to a bleach-fixing tank. Also, formulation for the bleaching agent part described in the Example contains a sulfinic acid compound.

However, as is the same with patent document 1, there has been involved a problem that, in rapid processing, there results insufficient removal of silver when formulation of the bleach-fixing solution varies in the direction that silver-removing activity is reduced. Also, with acceleration of the processing, it has the essential defects to a bleach-fixing solution that the minimum yellow density is increased, that stain with time of a treated light-sensitive material is increased due to insufficient removal of a residual developing agent by washing and that precipitation occurs in a running solution for bleaching.

Additionally, patent document 3 is given for reference though not a conventional art, since it involves the step and the additives included in the constituents of the invention. Patent document 3 discloses that, in a processing of successively conducting color development, bleaching and fixing, color stain of a light-sensitive material can be prevented by incorporating a sulfinic acid compound in the bleaching solution. It relates to the technique of the invention to be described hereinafter in the point of the above-described processing steps and the use of sulfinic acid compound. However, the processing disclosed therein is a processing which is mainly applied to light-sensitive materials for photographing use and takes a period of from several minutes to ten and several minutes, and color stain with the processing is different from stain that accompanies shortening of processing time, thus the processing being different from the invention in the object of the invention, constitution and subject to be solved.

Further, there are no descriptions therein that permit analogical reasoning to the advantage of the invention to remove the defects essential to a bleach-fixing solution accompanying acceleration of the bleach-fixing solution in rapid processing that the minimum yellow density is increased, that stain with time of a treated light-sensitive material is increased due to insufficient removal of a residual developing agent by washing and that precipitation occurs in a running solution for bleaching and in the concentrated solution.

As the aforesaid conventional art relating to the invention of this application, there are the following literatures.

Patent document 1: JP-A-7-234488

Patent document 2: JP-A-2004-53921

Patent document 3: JP-A-9-166854

Non-patent document 1: Kosugi, Netsugenzo Kakusan Tenshagata Kara Purinta (Thermally developable diffusion transfer color printer); Nippon Shasin Gakkaishi, Vol. 64(5), pp. 292-296 (2002)

DISCLOSURE OF THE INVENTION

Problems that the Invention is to Solve

As is seen with the foregoing conventional art, there has been found no satisfactory means which provides both pictorial image quality and rapidness of processing with no limitation nor defects upon use in order to meet needs of recent-year customers for mini-labs. As a result of intensive investigations to find means for solving the problem, the inventor has found that, when silver halide color paper is subjected to color developer treatment and then to a two-step silver-removing treatment (also called separate type processing) wherein bleaching solution treatment is accompanied by treatment in a solution having a fixing ability, silver can unexpectedly be extremely rapidly removed in spite of an increase in number of processing steps in comparison with general-purpose bleach-fixing treatment, thus shortening of the processing time becoming possible.

However, when the silver-removing step is performed extremely rapidly, there arise problems that the minimum yellow density is increased, that stain with time of a treated light-sensitive material is increased due to insufficient removal of a residual developing agent by washing and that precipitation occurs in a running solution for bleaching. The invention solves the problems by adjustment of the concentration of the processing composition and addition of a sulfinic acid compound, and renders possible an extremely rapid silver-removing treatment.

Further, since mini-labs are set up at a shop front, it has also been demanded that the amount of waste, whether solid or liquid, be minimized, and that, if possible, the amount be zero. Regarding this point, it has also been demanded that the amount of over-flow in the processing steps be small and, therefore, that the amount of replenisher be small. For example, in the processing method described in each Example of the patent document 1, too, the amount of replenisher of a bleach-fixing solution is as small as 35 $m^2$ per $m^2$ of a light-sensitive material. The smaller the amount of replenisher, the more preferred.

The invention is made with the background described above, and the object thereof is to provide a method for processing silver halide color paper which method can make possible the above-described separate type rapid processing, can provide a customer visiting a mini-lab with satisfaction in both image quality of finished prints and "convenient and quick" feel, and can reduce the amount of replenisher.

Specifically, the object is to provide a method for processing silver halide color paper (a) which can be conducted with such rapidness that finished prints can be handed to the customer at the spot, (b) which requires only a small installation area suited for a mini-lab, (c) which ensures processing solution stability suffering less deterioration even in slack seasons, (d) which can always keep normal image quality, (e) which requires only a small amount of replenisher, and (f) with which, even when color paper is extremely rapidly processed, the minimum yellow density is not increased, stain with time of a treated light-sensitive material due to insufficient removal of a residual developing agent by washing is not increased, and precipitation does not occur in a running solution for bleaching.

Means for Solving the Problems

The above-described objects can be attained by the present invention of the following constitution.

(1) A concentrated processing solution for silver halide color paper, which comprises as constituting parts:

a concentrated processing composition for bleach replenishment; and a concentrated processing composition for a replenisher having fixing ability, wherein the concentrated processing composition for bleach replenishment and the concentrated processing composition for a replenisher having fixing ability comprise at least the following constituents respectively, and the concentrated processing solution is for use in a processing comprising steps of treatment in a color developer, subsequent treatment in a bleaching solution and subsequent treatment in a solution having fixing ability:

Concentrated processing composition for bleach replenishment

| | |
|---|---|
| EDTA•Fe(III)•ammonium | 0.3 mol/L or more |
| Sulfinic acid compound represented by formula (I) | 0.01 mol/L or more |
| Ammonium bromide | 0.5 mol/L or more |
| pH | 3.0 or less |

$RSO_2M$ Formula (1)

wherein R represents an alkyl group, a cycloalkyl group, an alkenyl group, an alkynyl group, an aralkyl group, an aryl group or a hetero ring group; and M represents a hydrogen atom, an alkali metal atom, an ammonio group or a quaternary amino group; and Concentrated processing composition for a replenisher having fixing ability

| | |
|---|---|
| Ammonium thiosulfate | 0.7 mol/L or more |
| Ammonium sulfite | 0.4 mol/L or more |
| pH | 4.0 or more. |

(2) The concentrated processing composition for silver halide color paper as described in (1) above, wherein the concentrated processing composition for bleach replenishment comprises a tribasic acid.

(3) The concentrated processing composition for silver halide color paper as described in (2) above, wherein the concentrated processing composition for bleach replenishment comprises citric acid and/or sulfosuccinic acid as the tribasic acid.

(4) The concentrated processing composition for silver halide color paper according to any of (1) to (3) above, which further comprises as a constituting part a concentrated processing composition for color-developing replenisher comprising 2-methyl-4-[N-ethyl-N-(β-methylsulfoamidoethyl)amino]aniline or a salt thereof.

(5) A method for processing silver halide color paper, which comprises processing steps comprising:

a step of treatment in a color developer;

a subsequent step of treatment in a bleaching solution; and a subsequent step of treatment in a solution having fixing ability, wherein a light-sensitive material is conveyed in a solution without being in tough with an air between the treatment in the bleaching solution and the treatment in the solution having fixing ability, sum of the processing time of the treatment in the bleaching solution and the treatment in the solution having fixing ability is 12 seconds or shorter, and the treatments are continuously conducted using the concentrated processing composition for silver halide color paper according to any of (1) to (4) above.

(6) The method for processing silver halide color paper according to (5) above, wherein a bleaching replenisher to replenish a bleaching tank and a fixative replenisher to replenish a processing tank for a solution having fixing ability are replenishers prepared from the concentrated processing composition for silver halide color paper according to any of (1) to (4) above, and sum of amounts of individual replenishers is 35 mL or less per $m^2$ of color paper.

ADVANTAGES OF THE INVENTION

Regarding processing steps, the first feature of the concentrated processing composition for color paper and the processing method of the invention lies in employing a separate type bleach-fixing treatment of separately conducting a treatment in a bleaching solution and a treatment in a fixing solution (or a bleach-fixing solution) in two steps subsequent to color development, and incorporating a sulfinic acid compound in a concentrated processing composition for bleaching. Thus, the presence of the sulfinic acid compound can effectively suppress an increase in the minimum yellow density, an increase in stain with time of a treated light-sensitive material due to insufficient removal of a residual developing agent by washing and precipitation occurring in a running solution for bleaching, thereby the separate processing being made practical.

The second feature of the concentrated processing composition and the processing method of the invention lies in that, in addition to the above-described separate type bleach-fixing treatment, the manner of conveying a light-sensitive material is a manner wherein the light-sensitive material is conveyed in a solution without being in touch with the air between a treating tank retaining a bleaching solution and a treating tank retaining a solution having fixing ability, thereby processing time being further shortened by combining the separate treatment and the in-solution conveying manner.

The concentrated processing compositions and the processing method of the invention having the above-described features can exert various effects as will be described in the following section meeting the above-described subjects.

The invention characterized by the separate type processing using a bleaching solution containing a sulfinic acid compound and the second invention of a processing method for color paper wherein, in addition to this, a light-sensitive material is conveyed without being in touch with the air between the bleaching treatment and the treatment in a solution having fixing ability and concentrated processing compositions for the bleaching solution and the solution having fixing ability to be used in the processing can further shorten the processing period and, in addition, can suppress troubles such as deposition of tar onto members of a bleaching tank or onto light-sensitive materials during continuous processing or generation of sulfuration in a processing tank having fixing ability. As a result, (a) rapid processing (e.g., bleaching and fixing being conducted within 12 seconds) becomes possible which permits to hand finished prints to a customer at the spot, (b) size of the processing machine can be reduced, whereby an installation area for the machine can be small enough to cope with the limited space of a mini-lab, (c) oxidation of the fixing solution with the air can be suppressed and, in addition, deterioration with time accompanying contamination or the like of the processing solution is reduced, thus processing solution stability being ensured even in slack seasons and, therefore, (d) normal image quality is always maintained. Further, (e) the total replenishing amounts of the bleaching solution and the fixative processing solution can be reduced, thus the discharge amount of a waste photographic processing solution being reduced.

DESCRIPTION OF REFERENCE NUMERALS AND SIGNS

Figure 1:
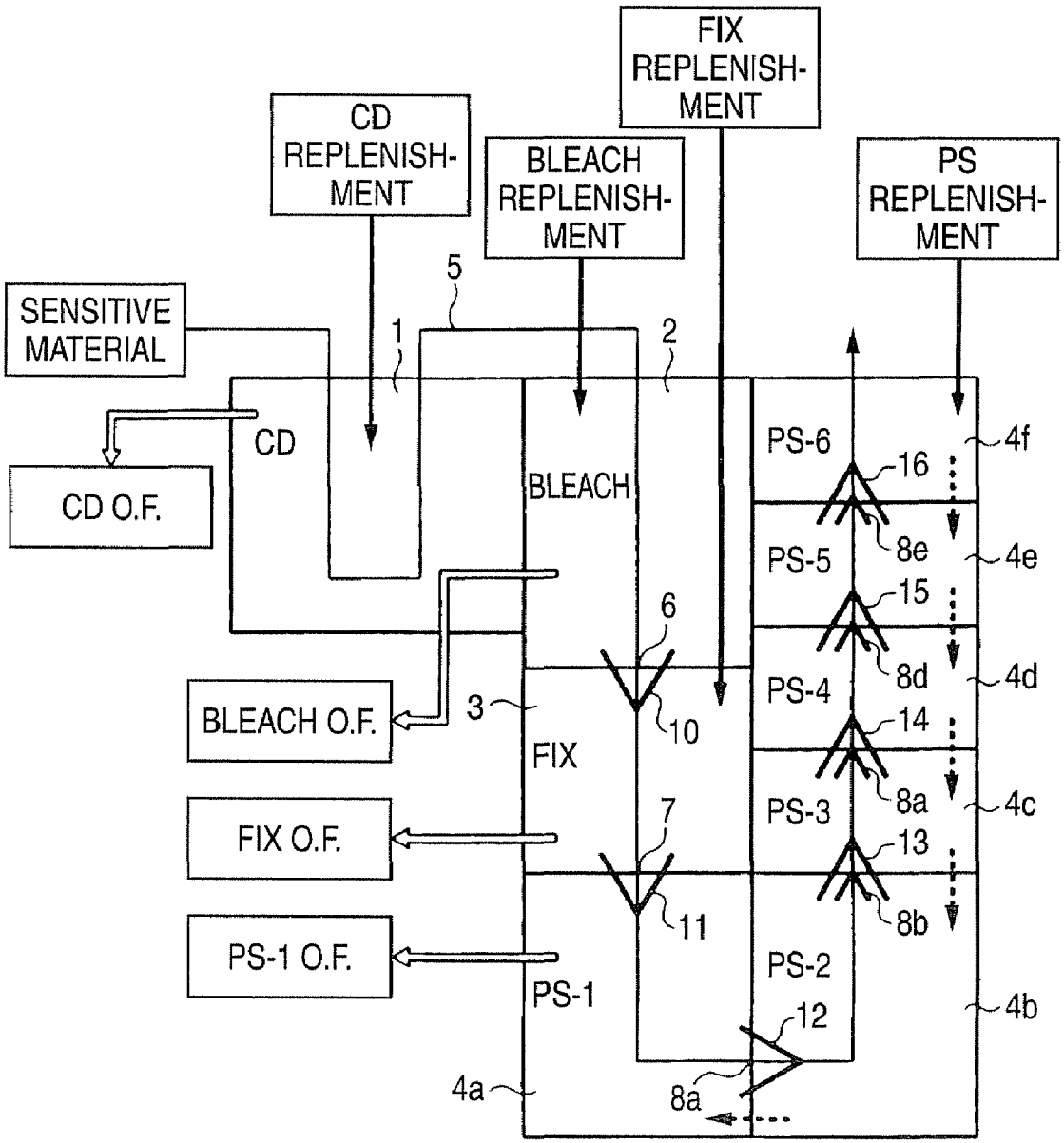
FIG. 1 is a constitutional drawing showing a constitution of a typical embodiment of a development processing apparatus of the invention.

CD Color developer
Bleach Bleaching solution
Fix Fixing solution
PS-1 to PS-6 First to sixth rinsing solutions
CDO.F. Color development overflow
Bleach O.F. Bleaching overflow
Fix O.F. Fixing overflow
PS-1 O.F. Rinsing overflow
1 Color developing tank
2 Bleaching tank
3 Fixing tank
4*a* First rinsing tank
4*b* Second rinsing tank
4*c* Third rinsing tank
4*d* Fourth rinsing tank
4*e* Fifth rinsing tank
4*f* Sixth rinsing tank
5 Conveying passage in the air
6 7, 8*a* to 8*b* In-solution conveying passages
10 11, 12 Single blade
13 14, 15, 16 Double blade
30 Sealing means
31 Blade
32 Tank wall
33 Slit

BEST MODE FOR CARRYING OUT THE INVENTION

The concentrated processing compositions for color paper of the invention and the processing method using the same will be described in more detail below.

The concentrated processing compositions of the invention are a concentrated processing composition for bleach replenishment and a concentrated processing composition for fixative replenishment to be used in separate type bleach-fixing wherein a bleaching treatment is conducted subsequent to color development, and then treatment in a processing solution having fixing ability (fixing solution or bleach-fixing solution) is conducted.

The concentrated processing composition for bleach replenishment is constituted by at least the following components.

Concentrated Processing Composition for Bleach Replenishment

| | |
|---|---|
| EDTA•Fe(III)•ammonium | 0.3 mol/L or more |
| Sulfinic acid compound represented by formula (I) | 0.01 mol/L or more |
| Ammonium bromide | 0.5 mol/L or more |
| PH | 3.0 or less |

$RSO_2M$ Formula (I)

In the formula (I), R represents an alkyl group, a cycloalkyl group, an alkenyl group, an alkynyl group, an aralkyl group, an aryl group or a hetero ring group, and M represents a hydrogen atom, an alkali metal atom, an ammonio group or a quaternary amino group.

The concentration of EDTA.Fe(III) ammonium complex salt is preferably from 0.3 to 1 mol/L, more preferably from 0.4 to 0.8 mol/L.

The concentration of EDTA.Fe(III) ammonium in the concentrated processing composition may be at a high level as long as its solubility permits, but a preferred range is the above-described range of not exceeding 1 mol/L. Within this range, the processing composition is more stable against formation of a precipitate and, when the concentration is 0.3 mol/L or more, adaptability to the separate processing and rapidness of the processing which meet the objects of the invention and low replenishment are ensured.

As the bleaching agent, other known bleaching agents can also be used as long as the amount of EDTA.Fe(III) ammonium exceeds 50 mol %. In the case of using known bleaching agents together with EDTA.Fe(III) ammonium, the amount thereof is preferably 30 mol % or less, more preferably 15 mol % or less, of the total bleaching agents, with addition of no known bleaching agents being most preferred. As the bleaching agents that can be used together with EDTA.Fe(III) ammonium, there are illustrated iron (III) complex salts of organic acids such as citric acid, tartaric acid, malic acid and amiopolycarbocylic acids other than EDTA.Fe(III) ammonium, persulfates, hydrogen peroxide, etc.

As preferred Fe (III) aminopolycarboxylate complex salts other than EDTA.Fe(III) ammonium, there can be illustrated Fe (III) complex salts of ethylenediaminetetraacetic acid, diethylenetriaminepentaacetic acid, 1,3-diaminopropanepentaacetic acid, propylenediaminetetraacetic acid, nitrilotriacetic acid, cyclohexanediaminetetraacetic acid, iminodiacetic acid and glycol ether diaminetetraacetic acid as well as biodegradable ethylenediaminedisuccinic acid (SS body), N-(2-carboxylatoethyl)-L-aspartic acid, β-alaninediacetic acid and methyliminodiacetic acid. These compounds may be any of sodium, potassium, lithium and ammonium salts. Of these compounds, ethylenediaminedisuccinic acid (SS body), N-(2-carboxylatoethyl)-L-aspartic acid, β-alaninediacetic acid, ethylenediaminetetraacetic acid, 1,3-diaminopropanetetraacetic acid and methyliminodiacetic acid are preferred, since the Fe (III) complex salts thereof provide good photographic properties.

The composition for bleach replenishment may contain a non-chelated aminopolycarboxylic acid, particularly EDTA, its alkali metal salt or ammonium salt in an amount of from about 0.1 to about 3 mol % based on the corresponding Fe (III) complex salt. Copresence of the non-chelated organic acid corresponding to the Fe (III) complex salt provides the advantage that stability of the Fe (III) complex salt is improved.

The concentration of the bleaching agent in the concentrated processing composition for bleach replenishment is determined so that the concentration of the bleaching agent in a bleaching solution prepared from the processing composition becomes from 0.01 to 1.0 mol/L, preferably from 0.03 to 0.80 mol/L, more preferably from 0.05 to 0.70 mol/L, still more preferably from 0.07 to 0.50 mol/L.

The sulfinic acid compound represented by the formula and to be incorporated in the concentrated processing composition for bleach replenishment will be described below.

It has already been known to add a sulfinic acid compound to a processing solution. For example, JP-A-1-230039 describes a processing method wherein a sulfinic acid compound is incorporated in at least one of processing steps, and it is described therein that the sulfinic acid compound may be incorporated in a bleaching solution. However, regarding the bleaching solution itself, objects or effects of addition of the sulfinic acid compound to the bleaching solution are not described therein, and nothing is described therein as to suppression of increase in the minimum yellow density, increase in stain with time of a treated light-sensitive material due to insufficient removal of a residual developing agent by washing and occurrence of precipitation in a running solution for bleach-fixing, which is the subject of the invention to solve. In the above-mentioned specification, it is described that the effects become remarkable when the time of the silver-removing step is shortened. However, it does not apply to the present invention, thus the invention described in the specification is an invention different from the present invention in objects and effects.

Compounds of the formula (1) will be described in detail. R represents a substituted or unsubstituted alkyl group (a methyl group, an ethyl group, a n-propyl propyl group, a hydroxyethyl group, a sulfoethyl group, a carboxyethyl group, a methoxyethyl group, etc.), a substituted or unsubstituted-alkenyl group (an allyl group, a butenyl group, etc.), a substituted or unsubstituted aralkyl group (a benzyl group, a phenethyl group, a 4-carboxyphenylmethyl group, a 3-sulfophenylmethyl group, etc.), a substituted or unsubstituted cycloalkyl group (a cyclohexyl group, etc.), a substituted or unsubstituted aryl group (a phenyl group, a 4-methylphenyl group, a naphthyl group, a 3-carboxyphenyl group, a 4-methoxyphenyl group, a 3-sulfophenyl group, a 4-carboxymethoxyphenyl group, a 3-carboxymethoxyphenyl group, a 4-carboxyethoxyphenyl group, a 4-sulfoethoxyphenyl group, a 4-carboxymethylphenyl group, 4-(N-carboxymethyl-N-methyl)phenyl group, etc.) or a substituted or unsubstituted hetero ring group (a pyridyl group, a furyl group, a thienyl group, a pyrazolyl group, an indolyl group, etc.). M represents a hydrogen atom, an alkali metal atom, an ammonio group or a quaternary amino group, and is exemplified by a hydrogen atom, an alkali metal atom, a nitrogen-containing organic base and an ammonio group. As the alkali metal atom, there are illustrated Na, K, Li, etc. and, as the nitrogen-containing organic base, there are illustrated common amines capable of forming a salt with a sulfinic acid compound. As the ammonio group, there are illustrated an unsubstituted ammonio group, a tetramethylammonio group, etc.

In the case where the group represented by R has a substituent, examples thereof include a nitro group, a halogen atom (a chlorine atom, a bromine atom, etc.), a cyano group, an alkyl group (a methyl group, an ethyl group, a propyl group, a carboxymethyl group, a carboxypropyl group, a sulfoethyl group, a sulfopropyl group, a dimethylaminoethyl group, etc.), an aryl group (a phenyl group, a naphthyl group, a carboxyphenyl group, a sulfophenyl group, etc.), an alkenyl group (an allyl group, a butenyl group, etc.), an aralkyl group (a benzyl group, a phenethyl group, etc.), a sulfonyl group (a methanesulfonyl group, a p-toluenesulfonyl group, etc.), an acyl group (an acetyl group, a benzoyl group, etc.), a carbamoyl group (an unsubstituted carbamoyl group, a dimethylcarbamoyl group, etc.), a sulfamoyl group (an unsubstituted sulfamoyl group, a methylsulfamoyl group, a dimethylsulfamoyl group, etc.), a carbonamido group (an acetamido group, a benzamido group, etc.), a sulfonamido group (a methanesulfonamido group, a benzenesulfonamido group, etc.), an acyloxy group (an acetyloxy group, a benzoyloxy group, etc.), a sulfonyloxy group (a methanesulofonyloxy group, etc.), an ureido group (an unsubstituted ureido group, etc.), a thioureido group (an unsubstituted thioureido group, a methylthioureido group, etc.), a carboxylic acid or its salt, a sulfonic acid or its salt, a hydroxyl group, an alkoxy group (a methoxy group, an ethoxy group, a carboxyethoxy group, a carboxymethoxy group, a sulfoethoxy group, a sulfopropyloxy group, etc.), an alkylthio group (a methylthio group, a carboxymethylthio group, a sulfoethylthio group, etc.) and an amino group (an unsubstituted amino group, a dimethylamino group, an N-carboxyethyl-N-methylamino group, etc.).

Specific compounds of the formula (I) are illustrated below. However, compounds represented by the formula (I) are not limited only to them. Also, although the compounds illustrated below are shown in forms wherein sulfinic acid group and carboxylic acid group are mainly shown in the acid form or in the form of salt with Na or K metal, but they may be in the form of salts with other alkali metals or may be the above-described elements or groups.

I-1 $CH_3SO_2H$.

I-2 $CH_3SO_2Na$.

I-3 $CH_3SO_2K$.

I-4 $C_2H_5SO_2H$.

I-5 $C_2H_5SO_2Na$.

I-6 $H_2NCH_2CH_2SO_2H$.

I-7 $H_2NCH_2CH_2SO_2Na$.

I-8 $H_3\overset{+}{N}CH_2CH_2SO_2^-$.

I-9 $HOCH_2CH_2SO_2Na$.

I-10 $HOCH_2CH_2SO_2H$.

I-11 $HOOCCH_2CH_2SO_2Na$.

I-12 $H_4NOOCCH_2CH_2SO_2H$.

I-13 $F_3CSO_2H$.

I-14 $NaSO_2CH_2CH_2SO_2Na$.

I-15 $H_2N(NH)CNHCH_2CH_2SO_2H$.

I-16 $CH_3CH(OH)SO_2K$.

-continued

I-17 $CH_3CH(OH)SO_2H$.

I-18 $HOOC-CH(NH_2)CH_2SO_2Na$.

I-19

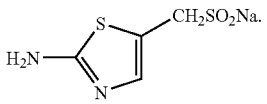

I-20 $CH_3SO_2Li$.

I-21 $HOOCCH(NH_2)CH_2SO_2H$.

I-22 $CH_3SO_2^-\ \overset{+}{N}(CH_3)_4$.

I-23 $H_3C-\overset{+}{N}(CH_3)_2CH_2CH_2SO_2^-$.

I-24 $H_2NCH_2CH_2CH(NH_2)CH_2SO_2H$.

I-25

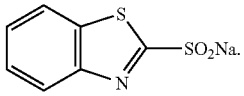

I-26

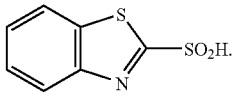

I-27 $C_3H_7SO_2H$.

I-28 $C_3H_7SO_2Na$.

I-29 $C_4H_8SO_2H$.

I-30 $C_6H_{13}SO_2Na$.

I-31 $CH_3CONHCH_2SO_2H$.

I-32

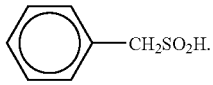

I-33

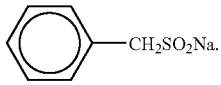

I-34

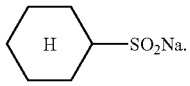

I-35

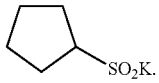

I-36

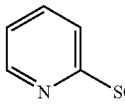

-continued

I-37

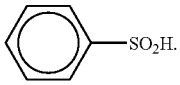

I-38

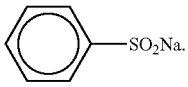

I-39

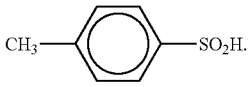

I-40

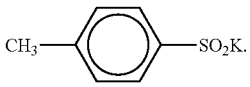

I-41

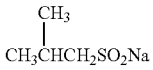

I-42

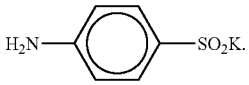

I-43

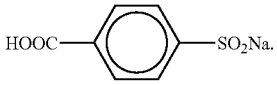

I-44

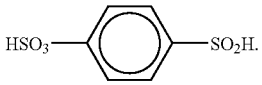

I-45

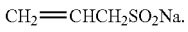

I-46

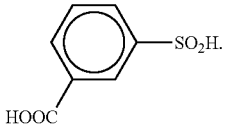

I-47

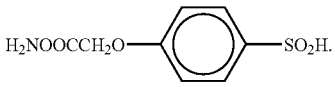

I-48

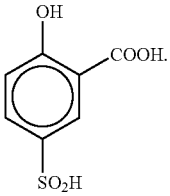

I-49

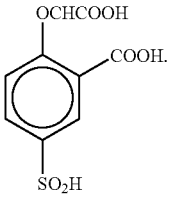

-continued

I-50

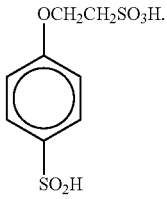

I-51

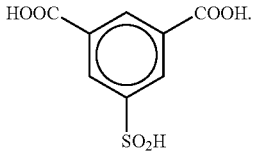

Preferred sulfinic acid compounds are p-tolylsulfinic acid, p-hydroxybenzenesulfinic acid, methylsulfinic acid, m-carboxybenzenesulfinic acid, p-carboxybenzenesulfinic acid, 2,4-dicarboxybenzenesulfinic acid and 4-acetylcarboxybenzenesulfinic acid. Of these, m-carboxybenzenesulfinic acid is preferred. These compounds may be used in the form of free acids or salts of alkali metals such as potassium salt, sodium salt and lithium salt. It is also possible to use two or more of the compounds in combination thereof.

The addition amount of the sulfinic acid compound is preferably from 0.01 to 0.2 mol, more preferably from 0.03 to 0.1 mol, per liter of the concentrated composition for bleach replenishment. Also, an appropriate concentration used in a prepared bleaching solution is from 0.005 to 0.2 mol, preferably from 0.01 to 0.15 mol, from 0.015 to 0.10 mol, per liter of the bleaching solution. A plurality of them may be used in combination.

The compounds represented by the formula (I) are generally synthesized by a process of reducing sulfonyl chloride compounds. As reducing agents, zinc dust, sulfite ion, alkali metal sulfide, etc. are used. Other processes are also known. General processes for synthesizing compounds of the formula (I) including the above-described process are shown in, for example, Chem. Rev., vol. 4508, 69 (1951); Organic Synthesis, Collective Vol. I, 492 (1941); J. Am. Chem. Soc., vol. 72, 1215 (1950); and ibid., vol. 50, 792, 274 (1928).

The concentration of ammonium bromide in the concentrated composition for bleach replenishment is 5 mols/L or more, preferably from 0.6 to 4 mols/L, more preferably from 1 to 3 mols/L, per liter of the composition. Also, an appropriate concentration thereof used in a prepared bleaching solution is from 0.005 to 2 mols, preferably from 0.2 to 1 mol per liter of the bleaching solution.

The higher the concentration of ammonium bromide, the more increased is the bleaching power to shorten the bleaching time. However, as the concentration is increased, there results a smaller increase in the effects by the increase in concentration. Also, when the concentration of the bromide is less than the above-described range, there result less effects of ammonium bromide. Although alkali bromide is also known to increase bleaching activity, effects of ammonium bromide are extremely remarkable, and hence, ammonium bromide is used in the present invention as a halogenating agent.

Regarding the concentrated composition of the invention for bleach replenishment, it is of extreme importance for pH thereof to be 3.0 or less. Such a low pH provides a strong bleaching activity and can realize short-time bleaching. With known bleaching solutions, such a low pH would cause problems such as precipitation or decomposition of a Fe(III) complex salt bleaching agent. However, in the case of a combination of a bleaching agent of EDTA.Fe(III).ammonium and a halogenating agent of ammonium bromide, it has become possible to use them with stability in such a low pH region. A preferred pH is from 3 to 0.5, with a pH of from 3 to 1 being more preferred.

It is particularly preferred in view of preventing precipitation of the concentrated solution at low a temperature to incorporate a tribasic organic acid in the concentrated processing composition for bleach replenishment. As specific compounds of the tribasic acid, there can be illustrated citric acid, sulfosuccinic acid, aspartic acid, inosine, ornithine, guanine, glutamic acid, cysteine, tyrosine, etc. In the invention, citric acid and sulfosuccinic acid are particularly preferred. The addition amounts of these compounds are such that the concentration thereof in a prepared processing solution becomes preferably from 0.05 to 3.0 mols, more preferably from 0.2 to 1.0 mol, per L of the solution.

The concentrated processing composition for bleach replenishment can contain, in addition to the above-described compounds, various known organic acids (e.g., acetic acid, lactic acid, glycolic acid, succinic acid, maleic acid, malonic acid, tartaric acid, glutaric acid, etc.), organic bases (e.g., imidazole, dimethylimidazole, etc.) or compounds represented by the formula (A-a) described in JP-A-9-211819 including 2-picolinic acid or compounds represented by the formula (B-b) described in the same official gazette including kojic acid. The addition amounts of these compounds are such that the concentration thereof in a prepared processing solution becomes preferably from 0.05 to 3.0 mols, more preferably from 0.2 to 1.0 mol, per L of the solution.

A concentrated processing composition for a replenisher having fixing ability is constituted by at least the following components.

Concentrated Processing Composition for a Replenisher Having Fixing Ability

| | |
|---|---|
| Ammonium thiosulfate | 0.7 mol/L or more |
| Ammonium sulfite | 0.4 mol/L or more |
| pH | 4.0 or more |

Many known fixing chemicals are known as fixing agents but, in the invention, ammonium thiosulfate is used as the fixing agent in a concentration of 0.7 mol/L or more.

The concentration of ammonium thiosulfate is preferably from 0.7 to 5 mols/L, more preferably from 1 to 3 mols/L. An appropriate concentration thereof in a prepared processing solution having fixing ability for use is designed so that the concentration thereof in the prepared solution becomes preferably from 0.1 to 1 mol, more preferably from 0.2 to 0.8 mol, per L of the prepared solution.

In the concentrated processing composition for a replenisher having fixing ability or the processing solution prepared from the composition and having fixing ability, ammonium sulfite is used as a preservative. As is the same with the fixing agents, many known sulfites or bisulfites are known as preservatives but, in the invention, ammonium sulfite is used as the preservative in a concentration of 0.4 mol/L or more.

A preferred concentration of ammonium sulfite is from 0.4 to 3 mols/L, and a more preferred concentration thereof is from 0.8 to 2 mols/L. Also, An appropriate concentration thereof in a prepared processing solution having fixing ability for use is designed so that the concentration thereof in the prepared solution becomes preferably from 0.05 to 0.5 mol, more preferably from 0.1 to 0.4 mol, per L of the prepared solution.

In the concentrated composition of the present invention for fixative replenishment or the processing solution thereof, the pH is 4.0 or more, preferably from 4 to 8, more preferably from 5 to 8. A bleaching solution to be used in the separate processing of the invention preferably has a low pH as has been described hereinbefore. However, entrainment of the oxidizing solution with a low pH into a processing solution having fixing ability involves the risk of decomposing the fixing dye due to oxidation, and dyes generated by color development include dyes liable to be converted to the leuco form thereof (oxidative fading).

On the other hand, when pH of the bleaching solution is high, stain is liable to take place. Therefore, in the invention, the pH of the concentrated processing composition or the processing solution having fixing ability is selected in a proper region corresponding to the low pH of the concentrated composition for bleach replenishment or of the bleach replenisher to avoid the risk of the problems described above which might be encountered at a high pH or a low pH. It is possible not to use a pH-buffering agent in the bleaching composition or the composition for a solution having fixing ability by selecting such appropriate pH region.

In the case where adjustment of pH is required, it is possible to add, as needed, alkali agents of potassium hydroxide, sodium hydroxide, lithium hydroxide, lithium carbonate, sodium carbonate, potassium carbonate and acidic or alkaline buffering agents.

As a preservative for a concentrated processing composition for a replenisher having fixing ability, other preservatives such as sulfinic acid derivatives, ascorbic acid, carbonyl bisulfite adduct or carbonyl compounds may further be added in addition to ammonium sulfite.

Also, in either or both of the concentrated processing composition for a bleach replenisher and the concentrated processing composition for a replenisher having fixing ability may further be incorporated various fluorescent brightening agents, defoaming agents, surfactants, polyvinylpyrrolidone, etc.

<Container for the Concentrated Processing Composition>

The concentrated processing composition for a bleach replenisher or the concentrated processing composition for a replenisher having fixing ability is generally supplied in the form of being retained in a container. In view of stability with time of the composition, the container for the concentrated processing solution for a bleach replenisher preferably has a certain degree of oxygen permeation velocity, but may be the same as a container for the concentrated processing composition for a replenisher having fixing ability. With the former case, oxygen permeability can be ensured not necessarily by selecting an oxygen-permeable container material, but by reducing airtightness of the container through structure of, for example, an opening of the container. Preferred oxygen permeability with the former case is 4 mL or more in terms of the amount of permeated oxygen per day. The oxygen permeability is preferably 13 mL or less based on limitation as to thickness of the container wall for maintaining form of the container.

An example of a preferred container to be used in a typical embodiment of retaining the concentrated processing composition for a bleach relenisher or for the concentrated processing solution for a replenisher having fixing ability is a polyethylene bottle. Such polyethylene bottle is a container prepared from a single constituent resin of high-density polyethylene (hereinafter referred to as "HDPE") having a density of from 0.941 to 0.969 and a melt index in the range of from 0.3 to 5.0 g/10 min. The density is more preferably from 0.951 to 0.969, still more preferably from 0.955 to 0.965. Also, the melting index is more preferably from 0.3 to 5.0, still more preferably from 0.3 to 4.0. The melt index is a value measured according to the method specified in ASTM D1238 at a temperature of 190° C. and under a load of 2.16 kg. This container has a thickness of preferably from 500 to 1500 μm. However, containers for processing solutions to be used in the invention are not limited to the above-mentioned HDPE containers which are convenient for mounting on a developing machine, and containers prepared from other general-purpose materials for containers, for example, polyethylene terephthalate (PET), polyvinyl chloride (PVC), low-density polyethylene (LDPE), etc. than HDPE or, with HDPE, HDPE having a density and a melt index outside the scopes described above may also be used.

Another preferred embodiment of the container for the concentrated processing agent of the invention is a container constituted by flexible paper or plastic film, with a typical example thereof being a gadget pouch type film container.

The gadget pouch type film container comprises a columnar main part, with the opposed inner surfaces at the lower part of the columnar part being stuck to each other to seal up and form a bottom of the container, and the opposed inner surfaces at the higher part of the columnar part being peelably sealed to form a sealed part. A retained processing agent can be discharged by peeling apart the opposed inner surfaces of the sealed part and open the container.

Sealing method is not particularly limited as long as no troubles are involved upon opening and during storage, and any known sealing agent can be used. Any of heat-sealing method and solvent- or dilution-adhesion method may be employed.

As materials for constituting the gadget pouch type film container, those sheets are selected which can form a columnar packaging member and have flexibility are selected from among sheets such as steam-barrier paper, plastics, laminated paper, plastic-paper laminated material, metal foil-plastic laminated material, film comprising a PET substrate having vacuum deposited thereon aluminum, glass or silica and a composite material of these. As preferred examples of the materials, there are illustrated a composite material having a structure of PE/paper/PE/aluminum foil/PET/PE/PEF, a composite material having a structure of PE/paper/PE/aluminum foil/PET/PE, a composite material having a structure of PE/paper/PE/aluminum foil/PE, and the like.

Another preferred embodiment of the container for the concentrated processing agent which container is constituted by flexible paper or plastic film may be a gable-top type container also used as a cow's milk carton or a sake carton. Preferred materials for this type container are the above-described laminated structure materials and converted paper having been treated to make it water-proof.

Besides, an embodiment of being retained in a so-called cubitainer is also preferred which is inserted into a reinforcing corrugated carton to the inside measurement of the carton.

Containers of these types are preferably made of a material having a steam permeability of 200 mL/m$^2$·24 hrs·Pa or less. Additionally, oxygen permeation coefficient can be measured according to the method described in $O_2$ permeation of plastic container, Modern Packing; N. J. Calyan, 1968, No. 12, pp. 143-145. As a high-barrier packaging material, those which are described in Kinosei Hoso Zairyo no Shin-tenkai (Toray Research Center, February 1990), etc. can be used.

Also, containers having a low oxygen permeability and a low steam permeability which are disclosed in JP-A-63-17453 and vacuum packaging materials disclosed in JP-A-4-19655 and JP-A-4-230748 can be illustrated as preferred container materials to be referred.

The processing method of the invention will be described in more detail.

The separate type bleach-fixing treatment wherein treatment in a bleaching solution and treatment in a fixing solution are separately performed is applied to light-sensitive materials for photographing use such as color negative films and is a treatment employed for silver chlorobromide type color papers of year 1986 or older. However, color papers having been commercialized in and after year 1986 are replaced by silver chloride type color papers which permit bleach-fixing treatment. Thus, the separate type bleach-fixing treatment becomes old-fashioned. In the invention, however, it has been found that, when the separate type bleach-fixing treatment which is not at present employed for development-processing color papers on the world market is applied to silver chloride type color paper, treatment fatigue is markedly reduced with both a bleaching solution and a fixing solution, and both bleaching time and fixing time can markedly be shortened and, in addition, that the processing solutions suffer less fatigue with time even in slack seasons and development processing work can be performed with stability. Further, there have also been found advantages that the size of processing apparatus can be reduced owing to shortening of processing time and that the amount of consumed processing solution can be reduced owing to low fatigue properties, thus processing cost being reduced.

Further, in common color paper processing, there occur may troubles such as bleach fog or coloration failure (leuco dye trouble) since light-sensitive materials having been subjected to a color developing step migrates to a bleach-fixing step with a color developing solution being occluded therein. It has also been found that occurrence of these troubles can be suppressed by performing the separate type bleach-fixing treatment.

A further advantage of the invention is that contact of a light-sensitive material with the air is prevented between the bleaching treatment and the fixing treatment. For this purpose, an in-solution passage is employed for the light-sensitive material between a bleaching tank and a tank for a solution having fixing ability which passage is solution-tightly sealed so that the light-sensitive material can be passed therethrough. In a general-purpose development processing apparatus for color paper, conveyance of a light-sensitive material between processing tanks is conducted in the air by once taking out the light-sensitive material from a preceding processing tank, conveying it in the air, then soaked into a next tank. In the invention, however, at least conveyance of the light-sensitive material between the tank for a bleaching solution and the tank for a solution having fixing ability is conducted in a solution, thus eliminating the time for conveyance in the air. This serves to shorten the processing time and reduce the size of the processing apparatus, leading to reduction in the cost on apparatus. Also, since opening surface of the processing tank for a solution having fixing ability can substantially be eliminated, deterioration of the solution having fixing ability due to air oxidation or evaporation can be suppressed, thereby fixing activity being stably kept. This advantage can suppress an increase in Dmin (yellow stain) liable to occur in slack seasons or with a small-sized mini-lab and contributes to stability and improvement of quality. Further, the low fatigue properties serve to reduce the consumption of the processing solution, leading to reduction in processing cost. In the invention, these advantages are exhibited in addition to the above-mentioned advantages of the separate type treatment.

JP-A-7-234488 describes a development processing apparatus which has a passage for light-sensitive materials shielded by blades. However, the passage for light-sensitive materials employed in this apparatus has a zone where a light-sensitive material comes into contact with the air, and is therefore not solution-tight. Hence, even when this apparatus is used, such processing is different from the in-solution conveyance type processing, and the advantages of the in-solution conveyance type processing can not be expected.

Both the above-mentioned separate type treatment wherein the bleaching treatment and the treatment in a solution having fixing ability are separated and the in-solution conveyance processing of a light-sensitive material between tanks through a solution-tightly sealed passage are effective for shortening the processing time. Therefore, additive effects of acceleration by the two factors enable one to shorten the total period of bleaching time and time for treating in a solution having fixing ability to as short as 12 seconds or less, further 6 seconds or less. Limitation as to shortening of the treating time seems to be about 2 seconds with both bleaching time and fixing time. However, the shorter side of processing time is not limited as long as the processing is a processing wherein the separate type bleaching step and fixing step are employed and a light-sensitive material is conveyed through a solution-tight in-solution passage, with silver being sufficiently removed.

With shortening the time of the silver-removing step, the time required for the total steps of processing by dipping a light-sensitive material in a solution can also be shortened, and hence the time required for customers visiting a mini-lab to wait for receiving finished prints is shortened. Thus, superiority of ink jet method, thermally sensitive dye transfer method and thermally developable color diffusion transfer method whose processing time is short is relatively reduced.

A further advantage of the invention that is provided by the combination of the separate type processing wherein bleaching treatment and treatment in a solution having fixing ability are performed and the in-solution conveying processing of a light-sensitive material wherein both tanks are solution-tightly connected to each other is that the replenishing amounts of both a solution for bleaching treatment and a solution having fixing ability can be reduced. It is possible to treat light-sensitive materials with the amounts of both replenishers being as low as 35 mL, further 25 mL, per $m^2$ of light-sensitive material. This effect of reducing the replenishing amounts seems to be owing to that, since bleaching activity of the bleaching solution is high because silver potential of the bleaching solution can be made higher than that of the bleach-fixing solution, the amount of a consumed bleaching agent can be reduced corresponding to it, and that the amount of a consumed fixing agent can be reduced corresponding to the reduction of fatigue which is caused by contamination of the solution having fixing ability with the bleaching solution. That the amounts of the replenishers can be reduced means that the amount of waste liquor discharged by over-flow can be reduced. Since the dense waste liquor generated in the color paper processing is only the waste liquor from the bleach-fixing treatment (the amount of waste liquor from color development being in many cases negligible), the problem of waste liquor discharged from mini-labs can be solved by returning the waste liquor to a trader of supplying the treating agents for leaving disposal of the waste liquor upon returning containers for treating agents to the trader, which is a great advantage. (In color paper processing, a rinse over-flow is also discharged but, since it is an aqueous solution of a much less concentration, a disposing method of, for example, discharging into a sewage system after, as needed, removal of silver and adjustment of pH, which method can be performed in a region where a mini-lab exists, can be selected.)

As a further different advantage, there can be illustrated that the silver-recovering efficiency in recovering silver from an over-flow of a solution having fixing ability after separating an over-flow of a bleaching solution becomes higher in proportion to the reduction in the concentration of Fe(III) complex salt, which is economically advantageous.

Next, color processing steps to which the color paper processing method of the invention is applied will be described below.

The color development processing to which the concentrated composition of the invention for bleaching is applied comprises a color-developing step, a bleaching step, a fixing step, a rinsing or water-washing step and a drying step, with the processing solution of the fixing step being optionally a processing solution having fixing ability such as a bleach-fixing solution in place of the fixing solution. As has been described hereinbefore, a solution-tightly sealed passage for a light-sensitive material through which the light-sensitive material can pass is provided between the bleaching step and the fixing step, and the light-sensitive material is conveyed in a solution through the passage between the two processing tanks. Passages for the light-sensitive material between other steps are not limited to the in-solution conveyance type, and may be in-air conveyance system having an air time. Preferably, passages for a light-sensitive material between any two steps of dipping the light-sensitive material starting from introduction of the light-sensitive material into a color developing solution to completion of the final rinsing thereof are in-solution passages.

It is possible to insert an auxiliary step such as an intermediate rinsing step, an intermediate water-washing step and a neutralizing step between the steps of dipping the light-sensitive material in solutions. It is also possible to provide an image-stabilizing bath between the rinsing or water-washing step and the drying step for the purpose of stabilizing image in addition to the rinsing or water-washing step.

The replenishing amount of a color developing solution is preferably from 10 to 200 ml, more preferably from 15 to 150 ml, most preferably from 20 to 90 ml, per $m^2$ of light-sensitive material.

As has been described hereinbefore, the replenishing amounts of the bleaching solution and the fixing solution can be reduced, and are preferably from 5 to 50 ml, more preferably from 8 ml to 45 ml, most preferably from 10 to 35 ml, respectively, per $m^2$ of light-sensitive material. The sum of the replenishing amounts of the bleaching solution and the fixing solution is preferably from 10 to 100 ml, particularly preferably from 10 ml to 35 ml, most preferably from 10 to 25 ml. Also, the replenishing amount of a rinsing solution or washing water to a rinsing tank is preferably from 50 ml to 200 ml for all rinsing solutions.

Here, the color developing time is preferably 200 seconds or less, more preferably 120 seconds or less, still more preferably 80 seconds or less and 6 seconds or more. Likewise, the bleaching time is 30 seconds or less, preferably 15 seconds or less, more preferably 10 seconds or less, still more preferably 8 seconds or less and 2 seconds or more. The fixing time is 60 seconds or less, preferably 30 seconds or less, more preferably 20 seconds or less, still more preferably 10 seconds or less and 2 seconds or more. As has been described hereinbefore, the sum of the bleach-treating time and the fix-treating time is 12 seconds or less, particularly preferably 6 seconds or less and 2 seconds or more. Also, the rinsing or water-washing time is preferably 90 seconds or less, more preferably 60 seconds or less, still more preferably 30 seconds or less and 8 seconds or more, including the case of multi-tank constitution.

The temperature of the processing solution in the color-developing step, the bleaching step, the fixing step and the rinsing step is generally from 30 to 40° C. However, to conduct an accelerated processing at a high temperature of from 38 to 60° C., more preferably from 40 to 50° C., is also one embodiment of the invention.

Additionally, processing time for each step means a time from the point where a light-sensitive material is dipped in the processing solution of the step to the point where the light-sensitive material is dipped into a processing solution of the next processing step. In the case of processing in a common automatic developing machine, the sum of the time during which a light-sensitive material is dipped in a processing solution of the processing step and the time during which the light-sensitive material departs the processing tank and is conveyed in the air toward the next processing step (so-called air time) is taken as the processing time. With the development processing apparatus of the invention, the dipping time of the bleaching step is equal to the processing time. Also, the rinsing or water-washing time means the time from the point where a light-sensitive material is introduced into a rinsing tank or a water-washing tank to the point where the light-sensitive material is introduced to the drying step.

Also, the amount of rinsing solution can be set within a wide range depending upon properties of a light-sensitive material (based on, for example, kinds of used materials such as couplers) or application use thereof, temperature of the rinsing solution (water-washing water), number (number of steps) of the rinsing solution (water-washing tanks) and other various conditions. Of these, the relation between number of the rinsing solution tanks (water-washing tanks) in a multi-stage counter-current system and amount of water can be determined according to the method described in Journal of the Society of Motion Picture and Television Engineers, vol. 64, pp. 248-253 (1955, the May number).

Usually, the number of steps in multi-stage counter-current system is preferably from 3 to 10, particularly preferably from 3 to 5.

According to the multi-stage counter-current system, the amount of the rinsing solution can largely be decreased. Since bacteria grow with an increase in the staying time of water in the tanks to cause a problem such as deposition of resultant suspended solid to the light-sensitive material, use of a rinsing solution containing an anti-bacterial and anti-fungal agent to be described hereinafter is preferred as a countermeasure.

The color paper having been subjected to the development processing is subjected to a post treatment such as the drying step. In the drying step, from the viewpoint of decreasing the amount of water carried to the image film of the color paper, it is possible to promote drying by absorbing the water by a squeeze roller or cloth immediately after the development processing (rinsing step). Further, of course, the drying can be accelerated by increasing the temperature or changing the shape of the blowing nozzle to make the drying blow more effective. Further, as is described in JP-A-3-157650, the drying can also be accelerated by adjusting the angle of blow of the drying blow toward the light-sensitive material or by a method of removing discharged blow.

<Processing Solutions>

Next, processing solutions to be applied to the development processing method of the invention will be described. First, a color developing solution to be used for color development will be described.

In this specification, with every step, a tank solution retained in a processing tank and a replenishing solution to be added to the processing tank are inclusively referred to as processing solution (for example, a replenisher for color development being included in a color developing solution) unless there exists a special meaning to discriminate them from each other.

The color developing solution contains a color-developing agent.

Preferred examples of the color-developing agent are known aromatic primary amine color-developing agents, particularly p-phenylenediamine derivatives. Typical examples thereof are shown below which, however, are not limitative at all.

1) N,N-Diethyl-p-phenylenediamine
2) 4-Amino-3-methyl-N,N-diethylamine
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)aniline
7) 4-Amino-3-methyl-N-ethyl-N-(4-hydroxybutyl)aniline
8) 4-Amino-3-methyl-N-ethyl-N-(β-methanesulfonamidoethyl)aniline
9) 4-Amino-N,N-diethyl-3-(β-hydroxyethyl)aniline
10) 4-Amino-3-methyl-N-ethyl-N-(β-methoxyethyl)aniline
11) 4-Amino-3-methyl-N-(β-ethoxyethyl)-N-ethylaniline
12) 4-Amino-3-methyl-N-(3-carbamoylpropyl-N-n-propylaniline
13) 4-Amino-N-(4-carbamoylbutyl-N-n-propyl-3-methylaniline
15) N-(4-Amino-3-methylphenyl)-3-hydroxypyrrolidine
16) N-(4-Amino-3-methylphenyl)-3-hydroxymethyl)-pyrrolidine
17) N-(4-Amino-3-methylphenyl)-3-pyrrolidinecarboxamide Of the above-described p-phenylenediamine derivatives, illustrative compounds 5), 6), 7), 8) and 12) are particularly preferred, with compounds 5) and 8) being more preferred. Particularly, compound 8) (or 2-methyl-4-[N-ethyl-N-(β-methylsulfamidoethyl)amino]-aniline according to another nomenclature) is preferred. In a solid material state, these p-phenylenediamine derivatives are usually in the form of salts such as sulfates, hydrochlorides, sulfites, naphthalenedisulfonates or p-toluenesulfonates.

The aromatic primary amine developing agent is added to the processing solution so that its concentration becomes from 2 mmols to 200 mmols, preferably from 6 mmols to 100 mmols, more preferably from 10 mmols to 40 mmols, per L of the developing solution.

To the color-developing solution may be added an organic preservative as a preservative. The organic preservative means the whole organic compounds that can reduce deterioration rate of the aromatic primary amine color-developing agent when incorporated in the color-developing solution. That is, they are organic compounds which have the function of preventing air oxidation of the color-developing agent. Among them, hydroxylamine derivatives, hydroxamic acids, hydrazides, phenols, α-hydroxyketones, α-aminoketones, sugars, monoamines, diamines, polyamines, quaternary ammonium salts, nitroxy radicals, alcohols, oximes, diamide compounds and condensed-ring amines are particularly effective organic preservatives. These are disclosed in such official gazettes or specifications as JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

As other preservatives, various metals described in JP-A-57-44148 and JP-A-57-53749, salicylic acids described in JP-A-59-180588, alkanolamines described in JP-A-54-3532, polyethylenemines described in JP-A-56-94349, aromatic polyhydroxy compounds described in U.S. Pat. No. 3,746,544, etc. may be incorporated as needed. In particular, alkanolamines such as triethanolamine and triisopropanolamine, substituted or unsubstituted dialkylhydroxylamines such as disulfoethylhydroxylamine and diethylhydroxylamine, or aromatic polyhydroxy compounds may be added.

Of the aforesaid organic preservatives, hydroxylamine derivatives are described in JP-A-1-97953, JP-A-1-186939, JP-A-1-186940, JP-A-1-187557, etc. In particular, addition of both a hydroxylamine derivative and an amine is effective in the point of improving stability of a color developing solution and stability upon continuous processing.

As the amines, cyclic amines as described in JP-A-63-239447, amines as described in JP-A-63-128340, and amines as described in JP-A-1-186939 and JP-A-1-187557. The content of preservative in the processing solution varies depending upon kind of the preservative but, in general, the preservative is added so that the concentration thereof in the solution to be used becomes from 1 mmol to 200 mmols, preferably from 10 mmols to 100 mmols, per L of the developing solution.

A chloride ion may be added, as needed, to a color developing solution for color paper. The color developing solution usually contains a chloride ion in a content of from $3.5\times10^{-2}$ to $1.5\times10^{-1}$ mol/L. However, a chloride ion is usually released into the developing solution as a by-product of development, and hence, in many cases, it is not necessary for the chloride to add to a developing solution for replenishment.

Since the light-sensitive material to which the invention is applied is color paper, it is not necessary to incorporate a bromide ion in the color developing solution, but the color developing solution may contain the bromide ion in a content of from $100\times10^{-3}$ mol/L or less.

In the case of using a chloride ion as an additive component in a color developing solution, sodium chloride, potassium chloride, ammonium chloride, lithium chloride, nickel chloride, magnesium chloride, manganese chloride and calcium chloride are illustrated as chloride ion-supplying substances. Of these, sodium chloride and potassium chloride are preferably used.

The pH of the color developing solution is preferably from 9.0 to 12.0, and the pH of the replenisher for color development is preferably from 9.0 to 13.5. The pH of the color developing solution is more preferably from 9.0 to 10.5, and the pH of the replenisher for color development is more preferably from 9.0 to 12.0. Therefore, alkali agents, buffer agents and, as needed, acid agents can be added to the color developing solution and the replenisher for color development so as to maintain the pH value at the level.

Upon preparation of the color developing solution, various buffer agents are preferably used in order to keep the pH as described above. As the buffer agents, there can be used carbonates, phosphates, borates, tetraborates, hydroxybenzoates, glycylates, N,N-dimethylglycylates, leucine salts, norleucine salts, guanine salts, 3,4-dihydroxyphenylalanine salts, alanine salts, aminobyrtlates, 2-amino-2-methyl-1,3-propanediol salts, valine salts, proline salts, trishydroxyaminomethane salts, lysine salts, etc. Particularly, carbonates, phosphates, tetraborates and hydroxybenzoates are advantageous in that they are excellent in buffering ability within a higher range of pH of 9.0 or more, that they do not have adverse effects on photographic performances (e.g., fogging) even though they are added to a color developing solution, and that they are inexpensive. Accordingly, it is particularly preferred to use these buffer agents.

As specific examples of the buffer agents, there can be illustrated sodium carbonate, potassium carbonate, sodium bicarbonate, potassium bicarbonate, trisodium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium s-sulfo-2-hydroxybenzoate (sodium 5-sulfosalicylate), potassium 5-sulfo-2-hydjroxybenzoate (potassium 5-sulfosalicylate), etc. However, the invention is not limited only to these compounds.

The buffer agent is not a component which is subjected to a reaction and consumption. Thus, the amount of the buffer agent to be added to the composition is determined so that the concentration thereof becomes from 0.01 to 2 mols, preferably from 0.1 to 0.5 mol, per L of the color developing solution.

To the color developing solution may be added other components for a color developing solution, for example, various chelating agents which are agents for preventing precipitation of calcium or magnesium as well as agents for improving stability of a color developing solution. Examples thereof include nitrilotiacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, ethylenediaminedisuccinic acid (SS form), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, 1,2-dihydroxybenzene-4,6-disulfonic acid, etc.

These chelating agents may be added in combination of two or more thereof as needed.

The amount of these chelating agents may be a sufficient amount to sequester metal ions in a color developing solution. For example, the chelating agent is added to give about 0.1 g to about 10 g per L.

To the color developing solution may also be added, as needed, an optional development accelerator. Examples of the development accelerator which can be added as needed include thioether series compounds described in JP-B-37-16088, etc., p-phenylenediamine series compounds described in JP-A-52-49829, etc., quaternary ammonium salts described in JP-A-50-137726, etc., amine series compounds described in U.S. Pat. No. 2,494,903, etc., polyalkylene oxides described in JP-B-42-252-1, etc., and 1-phenyl- 3-pyrazolidones or imidazoles. The addition amount of the development accelerator in the composition for the developing solution or for the replenishing solution is determined so that the concentration thereof in the developing solution or the replenishing solution prepared therefrom becomes from 0.001 to 0.2 mol, preferably from 0.01 to 0.05 mol, per L of the solution.

To the color developing solution of the invention may be added, as needed, any antifogging agent in addition to the halide ion described hereinbefore. Typical examples of organic antifogging agents include nitrogen-containing hetero ring compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine and adenine.

Also, to the color developing solution may be added, as needed, various surfactants such as alkylsulfonic acids, arylsulfonic acids, aliphatic carboxylic acids, aromatic carboxylic acids, etc. The addition amount thereof in the composition for the developing solution or for the replenishing solution is determined so that the concentration thereof in the developing solution or the replenishing solution prepared therefrom becomes from 0.0001 to 0.2 mol, preferably from 0.001 to 0.05 mol, per L of the solution.

In the invention, a fluorescent brightening agent may be used as needed. As the fluorescent brightening agent, bis (triazinylamino)stilbenesulfonic acid compounds are preferred. As the bis(triazinylamino)stilbenesulfonic acid compounds, known or commercially available diaminostilbene series whitening agents can be used. As known bis(triazinylamio)stilbenesulfonic acid compounds, compounds described in, for example, JP-A-6-329936, JP-A-7-140625 and JP-A-10-140849 are preferred. Commercially available compounds are described in, for example, Senshoku Noto (Dyeing Note), 9th edition (Shikisen Sha), pp. 165-168. Among the compounds described in the literature, Blankophor BSU liq. and Hakkol BRK are preferred. In the case of incorporating the fluorescent brightening agent in the color developing solution, it is preferred to add it so that the concentration thereof in the solution becomes from 0.02 to 1.0 mol/liter.

The bleaching solution and the processing solution having fixing ability can be obtained by diluting the concentrated processing composition for bleach replenishment and the concentrated processing composition for replenishing a solution having fixing ability with water, and therefore are not described here.

As to a rinsing solution, a method of reducing the amount of calcium and magnesium described in JP-A-62-288838 can be used extremely efficiently. Also, isothiazolone compounds and thiabendazoles described in JP-A-57-8542, chlorine-containing germicides such as chlorinated sodium isocyanurate described in JP-A-61-120145, benzotriazoles described in JP-A-61-267761, copper ion, and germicides described in Bokin-Bobai no Kagaku written by Hiroshi Horiguchi and published by Sankyo Shuppan in 1986, Biseibutsu no Genkin, Sakkin, Bobai Gijutsu compiled by Eisei Gijutsu-kai and published by Kogyo Gijutsu-kai in 1982, and Bokin-bobai Zai Jiten compiled by Nippon BOkin Bobai Kaggai Hen (1986) can be used.

Further, surfactants can be used as water-removing agents, and chelates represented by EDTA can be used as water softeners.

<Processing Apparatus>

A processing apparatus to which the processing method of the invention is applied is an apparatus which employs a step of conducting color development, a subsequent bleaching step and a subsequent step of conducting treatment in a processing solution having fixing ability, and an in-solution conveying system of conveying a light-sensitive material through a passage solution-tightly provided between the processing tanks.

In particular, a functional disposition embodying the above-described steps and the conveying system can be constituted by disposing in the processing apparatus of the invention a processing tank for a bleaching solution and a processing tank for a solution having fixing ability in a vertical relation (the processing tank for a bleaching solution being disposed over the processing tank for a solution having fixing ability), which serves to more reduce the floor area, thus being advantageous.

A typical embodiment of such development processing apparatus of the invention will be described below by reference to FIG. 1.

In the typical embodiment of the development processing apparatus in accordance with the invention which is shown in FIG. 1, there is employed a constitution wherein a color developing tank 1 retaining a color developing solution designated as CD, a bleaching tank 2 retaining a bleaching solution designated as Bleach, a fixing tank retaining a fixing solution designated as Fix, and 6 continuous rinsing tanks 4*a* to 4*f* respectively retaining the first to sixth rinsing solutions designated as PS-1 to PS-6 supplied in a countercurrent cascade system are disposed as shown in FIG. 1. The color developing tank 1, the bleaching tank 2, the fixing tank 3 and the 6th rinsing tank 4*f* are replenished with a replenisher for color development, a bleaching replenisher, a fixing replenisher and a rinsing replenisher, respectively, as shown by letters in a frame.

The color developing tank 1, the bleaching tank 2, the fixing tank 3 and the first rinsing tank 1 are equipped with a discharging means for discharging an overflow (O.F.) of each processing solution as designated by CD O. F., Bleach O. F., Fix O.F. or PS-1 O.F. When a rinsing replenisher designated by PS replenishment in FIG. 1 is introduced into the sixth rinsing tank 4*f*, the rinsing solution PS-6 within the sixth rinsing tank 4*f* becomes excessive due to the replenishment and the excess portion thereof is transferred to the fifth rinsing tank 4*e*. In such manner, the rinsing solution is transferred from the sixth rinsing tank 4*f* to the first rinsing tank 4*a* in a countercurrent cascade manner shown by the dotted arrows while the solution performing the rinsing treatment and, when the solution reaches the first rinsing tank 4*a*, it is discharged as a rinse overflow PS-1 O.F.

A light-sensitive material shown by letters in the frame is introduced into the color developing tank 1 along the passage for conveying the light-sensitive material shown by the solid line and, after color development processing, is introduced into the bleaching tank 2 thorough an in-air conveying passage 5 to perform bleaching treatment. Subsequently, the light-sensitive material is conveyed to the fixing tank 3 through an in-solution conveying passage 6 provided between the bleaching tank 2 and the fixing tank 3 and solution-tightly sealed by a single blade 10 (see FIG. 2) through which the light-sensitive material can pass. The light-sensitive material having been subjected to the fixing treatment in the fixing tank 3 is conveyed to the first rinsing tank 4*a* through an in-solution conveying passage 7 provided between the fixing tank 3 and the first rinsing tank 4*a* and solution-tightly sealed by a single blade 11 through which the light-sensitive material can pass. The light-sensitive material is subjected to the rinsing treatment in the first rinsing tank 4*a*, and then conveyed to the second rinsing tank 4*b* through an in-solution conveying passage 8*a* provided between the first rinsing tank 4*a* 2 and the second rinsing tank 4*b* and solution-tightly sealed by a single blade 12 through which the light-sensitive material can pass. In the second rinsing tank 4*b*, the rinsing treatment is continued. The light-sensitive material is conveyed from the second rinsing tank 4*b* to the sixth rinsing tank 4*f* through in-solution conveying passages 8*b* to 8*e* solution-tightly sealed by blades 13 to 16, respectively, while the rinsing treatment being further continued in the same manner. In the sixth rinsing tank 4*f*, the entire dipping treatment is completed, and the light-sensitive material is transferred to a drying step not shown where the light-sensitive material is dried to provide finished color, photograph (usually color print).

As the blades 13 to 16, double blades having two pairs of blades are used as is different from single blades of the blades 10 to 12. The double blades provide a higher solution-sealing level, and the amount of the solution transferred from the up-stream tank to the down-stream tank can be reduced. In this specification, the term "passage for a light-sensitive material solution-tightly sealed so that the light-sensitive material can pass therethrough" means a passage which has shielding properties of a level that permits slight transfer of the solution through a gap of a sealing member of the blade or shielding means having similar function as has been described hereinbefore. In other words, it means a passage which, when the solution pressure on the up-stream side with respect to the blade is higher than the solution pressure on the down-stream side, permits transfer of the solution in proportion to the difference in pressure but which, when the solution pressure on the up-stream side is equal to the solution pressure on the down-stream side, inhibits transfer of the solution except upon passing of the light-sensitive material (web) therethrough. During pause of the processing apparatus, the slit which functions as a passage for a light-sensitive material and which is provided in the tank wall is shielded by opposed blades in contact with each other or by one blade and the tank wall surface of the slit portion in contact with each other, thus the solution not being transferred.

Also, though not shown in FIG. 1, proper conveying means such as driving rollers (e.g., conveying rollers and nip rollers), opposed free rollers or zigzag-disposed rollers are provided along the in-solution conveying passage.

In FIG. 1, transfer of the rinsing solution between tanks for rinsing in the cascade manner shown by dotted arrows can be performed by providing means for transferring the solution between tanks of the countercurrent system, for example, by providing micro-pores permitting a nearly negligible degree of mixing of the solutions between tanks.

Next, means for providing the in-solution passage for a light-sensitive material between individual processing tanks, particularly between the bleaching tank and the tank having fixing ability which is necessary in the invention will be described. As this means, it is preferred to convey a light-sensitive material through blades as has been described in FIG. 1 as blades 10 to 16. The blades are provided on the passage so that, during a period wherein no light-sensitive material passes through the blades, the tips thereof are in close contact to each other. The blades are constituted so that, upon passage of a light-sensitive material, the tips in contact with each other are pressed apart by entering of the light-sensitive material. This blade preferably has a base portion to be attached to the passage and a free end (also referred to as a tip portion) whose thickness gradually decreases toward the tip. However, a blade whose thickness is about the same from the base portion toward the tip portion may also be employed. It is generally preferred to adjust the average inclination angle of the blade for the surface of a light-sensitive material to about 10 to about 70°, with about 20 to about 45° being particularly preferred. Also, the length between the base portion of the blade and the tip is adjusted to preferably from 10 to 50 mm, particularly preferably from 15 to 25 mm. The length of the overlap portion of a pair of blades disposed in an opposed position to each other is adjusted to preferably about from about 1 to about 10 mm, particularly preferably from about 2 to about 5 mm. These adjustments ensure close contact between the tip portions of the blades and can effectively inhibit a flow of each processing solution while no light-sensitive material passes therethrough. Also, a flow of each processing solution upon passing of the light-sensitive material can be minimized.

One example of blades to be applied for the purpose of enabling one to convey a light-sensitive material in a solution without contact with the air as described above are shown in FIG. 2 which, however, do not prevent use of other blades or sealing means having the same function in the invention.

Figure 2:
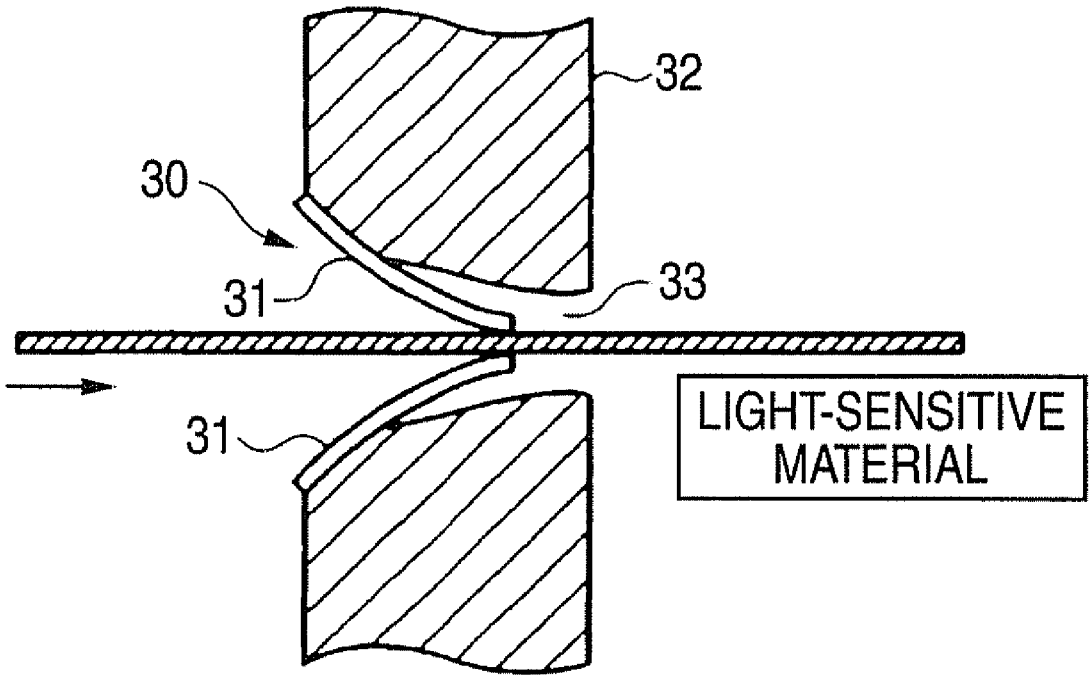
FIG. 2 is a cross-sectional view showing one embodiment of a single blade for an in-solution passage of a light-sensitive material in accordance with the invention.

FIG. 2 is a cross-sectional view of an in-solution conveying passage showing the state wherein a pair of single blades are provided on the wall surfaces of a processing tank to form an in-solution conveying passage for a light-sensitive material. In FIG. 2, a slit 33 is provided in a tank wall 32 of a processing tank so that a light-sensitive material can be transferred along the conveying direction shown by the arrow from the up-stream side (the left side of the tank wall 32) toward the down-stream side (the right side of the tank wall 32). Also, the cross-section of the tank wall 32 on the up-stream side is in a form inclined with respect to the passage so that an opening is formed on the up-stream side, and a pair of blades 31 contact with each other with the free ends thereof on the down-stream side and are fixed so that, upon passing of a light-sensitive material, they can sandwich the light-sensitive material from both sides. By bringing free ends of a pair of blades 31 into contact with each other directly or via a light-sensitive material (or a conveying belt) in the above-mentioned manner, there is formed a sealing means 30 which can prevent a processing solution in a tank on the up-stream side and a processing solution in a tank on the down-stream side from contacting with each other.

Therefore, during rest of a development processing machine, transfer of a processing solution in a tank on the up-stream side to the down-stream side is inhibited. While the processing machine is in operation, contamination of a processing solution on the down-stream side with a processing solution on the up-stream side occurs by passing of a light-sensitive material between the opposed free ends of the blades in a state of occluding the up-stream side processing solution in the light-sensitive layer thereof. However, the degree of contamination is such that the aforementioned effects of the invention can be maintained, thus the sealing system using the blades being preferred as a sealing means for embodying the invention.

Any material that does not exert detrimental influences on individual processing solutions may be used. Examples thereof include elastic materials such as various rubbers (e.g., natural rubber, chloroprene rubber, nitrile rubber, butyl rubber, fluorine-containing rubber, isoprene rubber, butadiene rubber, styrene-butadiene rubber and silicone rubber) and soft resins (e.g., polyurethane, soft polyvinyl chloride, polyethylene, polypropylene, ionomer resin, fluorine-containing resin and silicone resin). In particular, polyurethane is preferred in view of durability and leakage of solution.

The force of closely contacting the blades to each other is provided by the elastic force of the blades, but it is possible to impart or increase the closely contacting force by compounding a magnetic material in the tip portion of the blade (for example, something like rubber magnet) to attract the tip portions to each other. Also, when the light-sensitive material is conveyed in contact with the blades, detrimental influences such as scratches on the emulsion surface scarcely take place but, in the case where this is not negligible or where it is intended to reduce sliding resistance, it suffices to subject the inside surface of each blade to smoothening treatment or to surface treatment of, for example, coating a lubricant such as silicone or Teflon on the inside surface.

The linear velocity of conveying color paper in the development processing apparatus is preferably 100 mm/sec or less, more preferably from 27.8 mm/sec to 80 mm/sec, particularly preferably from 27.8 mm/sec to 60 mm/sec.

As to conveyance of color paper in the development processing apparatus, there are a system of performing development processing after cutting color paper into final size (sheet-type conveying system) and a system of conducting development processing color paper in a continuous sheet form and then cutting into final size (cine-type conveying system). The cine-type conveying system produces a waste of about 2 mm of a light-sensitive material between images, thus the sheet-type conveying system being preferred.

Color paper may be in a form of sheet or a roll. As to conveyance of a light-sensitive material in a development processing apparatus, a roller-conveying system is employed in an apparatus for processing sheet-shaped color paper and, in an apparatus for processing a roll-shaped paper, any of known systems such as a roller conveying system, a belt conveying system and a leader conveying system of splicing a leader to the tip of a roll may be employed.

Various materials for parts of a development processing apparatus to be employed for processing of the invention, and preferred materials are described below.

Materials for tanks such as a processing tank and a temperature-adjusting tank are preferably modified PPO (modified polyphenyleneoxide) and modified PPE (modified polyphenylene ether) resin. Examples of the modified PPO include "Noryl" manufactured by Nippon GE Plastics, and examples of the modified PPE include "Zylon" manufactured by Asahi Chemical Industry Co., Ltd. and "Upiace" manufactured by Mitsubishi Gas Chemical Company, Inc. These materials are suited for portions which might become contact with a processing solution, such as a processing rack and a cross-over rack.

As materials for rollers in the processing section, resins such as PVC (polyvinyl chloride), PP (polypropylene), PE (polyethylene) and TPX (polymethylpentene). These materials can also be used for other portions which are to be in contact with a processing solution. Additionally, PE resin is also preferred as a material for a replenisher tank formed by blow molding.

As materials for parts in the processing section, gears, sprockets, bearings and the like, resins such as PA (polyamide), PBT (polybutylene terephthalate), UHMPE (ultra-high-molecular polyethylene), PPS (polyphenylene sulfide) and LCP (all-aromatic polyester resin, liquid crystal polymer) are adequate. PA resin is a polyamide resin such as 66 nylon, 12 nylon or 6-nylon, and those which contains glass fibers or carbon fibers are resistant against swelling by the processing solution, thus being usable.

Also, products of a high molecular polymer such as MC nylon and compression-molded products can be used without fiber reinforcement. With UHMPE resin, non-reinforced products are adequate, and "Lubmer" and "Hizex Million" manufactured by Mitsui Petrochemical Industries, Ltd., "New Light" manufactured by Sakushin Kogyo Co., Ltd. and "Sunfine" manufactured by Asahi Chemical Industry Co., Ltd. are adequate. The molecular weight is preferably 1,000,000 or more, more preferably from 1,000,000 to 5,000,000.

PPS resins are preferably reinforced with glass fibers or carbon fibers. LCP resins include "Victrex" manufactured by ICI Japan Co., Ltd., "Ekonol" manufactured by Sumitomo Chemical Co., Ltd., "Zaider" manufactured by Nippon Oil Co., Ltd. and "Vectra" manufactured by Polyplastics Co., Ltd.

Also, with an apparatus using a conveyor belt, ultra-high tenacity polyethylene fibers or polyvinylidene fluoride resins disclosed in Japanese Patent Application No. 2-276886 are preferred as materials of the conveyor belt.

With an apparatus using squeegee rollers or the like, vinyl chloride foam resins, silicone foam resins and urethane foam resins are adequate as the soft materials for the squeegee rollers. Example of urethane foam resins include "Lubicel" manufactured by Toyo Polymer Co., Ltd.

An EPDM rubber and a byton rubber are preferred as rubber materials for the coupling of piping, the coupling of an agitation jet pipe and sealing materials.

[Light-sensitive Materials to which the Invention is Applied]

Next, color photographic light-sensitive materials to which the invention is to be applied are color papers, i.e., color papers for color prints. This light-sensitive material comprises a support having provided thereon at least one light-sensitive layer. A typical example thereof is a silver halide photographic light-sensitive material which comprises a support having at least one light-sensitive layer comprising a plurality of silver halide emulsion layers substantially different from each other in color sensitivity.

Light-sensitive materials for color print generally use a reflective support and, in many cases, a red-sensitive layer, a green sensitive layer and a blue-sensitive layer are provided in this order from the far side of the support. As a silver halide emulsion, an emulsion of cubic crystals of silver chloride grains or silver chlorobromide grains containing silver chloride at a high concentration is used.

Light-sensitive silver halide to be used for the light-sensitive material for color print preferably comprises crystal grains of cube substantially having a {100} plane or of tetradecahedron (these grains may have round apexes and, further, may have higher planes), crystal grains of octahedron or tabular grains of 2 or more in aspect ratio whose main plane comprises a {100} plane or a {111} plane. The term "aspect ratio" means a value calculated by dividing equivalent-circle projected diameter by thickness of grain. Regarding tabular grains whose main surface comprise a {100} plane or a {111} plane, reference may be made to JP-A-2000-352794, column 33 (p. 7) to column P840 (p. 8). In the invention, cubes are most preferred. The grain size is preferably 0.5 μm or less in side length of the cube, more preferably 0.4 μm or less.

As a photographic emulsion for a silver halide light-sensitive material to which the invention is to be applied, an emulsion containing silver halide grains with a specific silver halide content is used. In view of rapid processing, the content of silver chloride is required to be 90 mol % or more, and is preferably 93 mol % or more, more preferably 95 mol % or more. The content of silver bromide is preferably from 0.1 to 7 mol %, more preferably from 0.5 to 5 mol %, since it provides contrasty tone and latent image stability. The content of silver iodide is preferably from 0.02 to 1 mol %, more preferably from 0.05 to 0.50 mol %, most preferably from 0.07 to 0.40 mol %, since it provides high sensitivity and contrasty tone in high-intensity exposure. The silver halide grains of the invention are preferably silver iodobromochloride grains, with silver iodobromochloride grains of the above-mentioned halide composition being more preferred.

The silver halide emulsion to be used in the invention preferably contains iridium. As an iridium compound, a hexadentate complex having 6 ligands with iridium being a central metal is preferred in order to uniformly draw the complex into silver halide crystals. As one preferred embodiment of iridium to be used in the invention, hexadentate complexes having Cl, Br or I as ligands with Ir being a central metal are preferred, and hexadentate complexes wherein all of 6 ligands comprise Cl, Br or I with Ir being a central metal are more preferred. In this case, Cl, Br or I may be co-present in the hexadentate complex. In order to obtain a contrasty gradation by high-intensity exposure, it is particularly preferred to incorporate the hexadentate complex having Cl, Br or I as ligands with Ir being a central metal in a silver bromide-containing phase.

It is preferred to incorporate the above-mentioned iridium complex into silver halide grains by adding the complex directly to a reaction solution during formation of silver halide grains or by adding the complex to an aqueous solution of halides for forming silver halide grains or to other solution and then adding the solution to a reaction solution for forming grains. It is also preferred to incorporate the iridium complex into silver halide grains by conducting physical ripening with fine particles into which the iridium complex has previously been incorporated. Further, these techniques may be combined to incorporate the complex into silver halide grains.

The optimal amount of the metal complex may vary depending upon the size of silver halide grains into which the complex is to be incorporated, but the metal complex is used during formation of grains in an amount of preferably from $5\times10^{-10}$ mol to $1\times10^{-7}$ mol, more preferably from $2\times10^{-10}$ mol to $8\times10^{-8}$ mol, particularly preferably from $5\times10^{-10}$ mol to $5\times10^{-8}$ mol, per mol of silver.

Besides iridium and rhodium, other metal ions may be doped into the interior and/or the surface of silver halide grains. As the metal ion to be used, transition metal ions are preferred. Among them, iron, ruthenium, osmium, lead, cadmium or zinc is preferred. Further, it is more preferred to use these metal ions in the form of hexadentate, octahedral complexes having ligands. In the case of using inorganic compounds as the ligands, cyanide ion, halide ion, thiocyan, hydroxide ion, peroxide ion, azide ion, nitrite ion, water, ammonia, nitrosyl ion or thionitrosyl ion is preferably used. It is also preferred to coordinate them to any ion of metal of iron, ruthenium, osmium, lead, cadmium or zinc described above for use. It is also preferred to use plural kinds of ligands in one complex molecule. Also, organic compounds can be used as the ligands, and preferred organic compounds include chain compounds having 5 or less carbon atoms in the main chain and/or 5- or 6-membered hetero ring compounds. More preferred organic compounds are compounds having within the molecule a nitrogen atom, a phosphorus atom, an oxygen atom or a sulfur atom as a coordinating atom to a metal. Particularly preferred are furan, thiophene, oxazole, isoxazole, thiazole, isothiazole, imidazole, pyrazole, triazole, furazane, pyran, pyridine, pyridazine, pyrimidine and pyrazine. Further, compounds which have these compounds as fundamental skeletons and having substituents introduced to the skeletons are also preferred.

As spectrally sensitizing dyes to be used for spectrally sensitizing a light-sensitive silver halide emulsion to be used in the invention in the green and red regions, there can be illustrated, for example, those which are described in Heterocyclic compounds-Cyanine dyes and related compounds written by F. M. Harmer (John Wiley & Sons [New York, London], 1964). As to specific examples of the compounds and spectrally sensitizing methods, those which are described in foregoing JP-A-62-215272, p. 22, right and upper column to p. 38 are preferably used. Also, as red-sensitive spectrally sensitizing dyes for silver halide emulsion grains having a high silver halide content, spectrally sensitizing dyes described in JP-A-3-123340 are extremely preferred in view of stability, strength of adsorption and temperature dependence of exposure.

The silver halide emulsion is preferably subjected to gold sensitization known in the art. In gold sensitization, various inorganic gold compounds, gold (I) complexes having inorganic ligands and gold (I) compounds having organic ligands can be utilized. As the inorganic gold compounds, there can be used chloroauric acid and the salts thereof and, as the gold (I) complexes having inorganic ligands, there can be used dithiocyanate gold compounds such as potassium dithiocyanatoaurate (I) and dithiosulfate gold compounds such as trisodium dithiosulfoaurate (I).

Also, it is possible to use colloidal gold sulfide. A method of producing colloidal gold sulfide is described in Research Disclosure, 37154, Solid State Ionics, vol. 79, pp. 60-66, 1955, Compt. Rend. Hebt. Sciences, Acad. Sci. Sect. B, vol. 263, p. 1328, 1966, etc. In the above Research Disclosure, a method of using thiocyanate ion upon production of colloidal gold sulfide is described.1 It is possible to use a thioether compound such as methionine or thiodiethanol in place of the thiocyanate ion.

The above-mentioned gold sensitization may further be combined with other sensitizing method such as sulfur sensitization, selenium sensitization, tellurium sensitization, reduction sensitization or noble metal sensitization using other compound than the gold compound.

<Exposure>

Next, as a printer for preparing prints by development processing using the processing composition of the invention, a general-purpose printer is used. The composition is adapted for a scan-exposing system using a cathode ray tube (CRT) as well as a printing system using an ordinary negative printer. The cathode ray tube exposing apparatus is convenient and compact in comparison with a laser-using apparatus and is inexpensive. Also, it facilitates adjustment of light axis and color. In a cathode ray tube to be used for imagewise exposure, various light-emitting substances which emit light in a spectrum region may be used as needed. For example, one, two or more of a red light-emitting substance, a green light-emitting substance and a blue light-emitting substance are mixed to use. The spectrum region is not limited to the above-mentioned red, green and blue regions, and fluorescence-emitting substances which emit light in a region of yellow, orange, violet or infrared region may also be used. In particular, a cathode ray tube which contains the mixture of these light-emitting substances and emits white light is often used.

The light-sensitive material used in the invention is preferably used for a digital scanning exposure system using a monocolor high-density light emitted from, for example, a gas laser, a light-emitting diode, a semiconductor laser or a second harmonic-generating light source (SHG) wherein a semiconductor or a solid-state laser using a semiconductor as an exciting light source is combined with a non-linear optical crystal. In order to make the system more compact and inexpensive, it is preferred to use a semiconductor laser or a second harmonic-generating light source (SHG) wherein a semiconductor or a solid-state laser using a semiconductor as an exciting light source is combined with a non-linear optical crystal. In particular, in order to design an apparatus which is compact and inexpensive and which has a long life and a high stability, use of a semiconductor laser is preferred. It is preferred to use the semiconductor laser as at least one of exposing light sources.

A preferred scanning exposure system which can be applied to the invention is described in detail in the patents shown in the foregoing table. Also, in order to process a light-sensitive material according to the method of the invention, processing materials and processing methods described in JP-A-2-207250, p. 26, right and lower column, line 1 to p. 34, right and upper column, line 9, and JP-A-4-97355, p. 5, left and upper column, line 17 to p. 18, right and lower column, line 20 can preferably be applied.

EXAMPLES

The invention will be more specifically described below by reference to examples which, however, do not limit the scope of the invention in any way.

1. Preparation of Light-sensitive Materials to be Tested (Preparation of Blue-sensitive Layer Emulsion BH-1)

Cubic grains having a high silver chloride content were prepared by a method of simultaneously adding silver nitrate and sodium chloride to a deionized distilled water containing deionized gelatin under stirring to mix. In the course of this preparation, $Cs_2[OsCl_5(NO)]$ was added over a period of from the point where addition of silver nitrate was 60% to the point where addition of silver nitrate was 80%. Potassium bromide (1.5 mol % per mol of finished silver halide) and $K_4[Fe(CN)_6]$ were added thereto over a period of from the point where addition of silver nitrate was 80% to the point where addition of silver nitrate was 90%. $K_2[IrCl_6]$ was added over a period of from the point where addition of silver nitrate was 83% to the point where addition of silver nitrate was 88%. $K_2[IrCl_5(H_2O)]$ and $K[IrCl_4(H_2O)_2]$ were added over a period of from the point where addition of silver nitrate was 92% to the point where addition of silver nitrate was 98%. At the point where addition of silver nitrate was completed 94%, potassium iodide (0.27 mol % per mol of finished silver halide) was added thereto under vigorous stirring. The thus-obtained emulsion grains were monodisperse cubic silver iodobromochloride grains of 0.54 μm in side length and 8.5% in coefficient of variation. After subjecting this emulsion to desalting treatment by precipitation, gelatin, compounds Ab-1, Ab-2, Ab-3 and calcium nitrate were added thereto, followed by re-dispersing the mixture.

(Ab-1) antiseptic

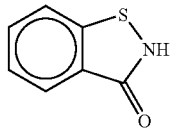

(Ab-2) antiseptic

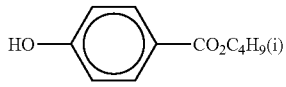

(Ab-3) antiseptic

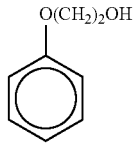

The re-dispersed emulsion was dissolved at 40° C., and a sensitizing dye S-1, a sensitizing dye S-2 and a sensitizing dye S-3 of the invention were added thereto so that spectral sensitization became optimal. Subsequently, sodium benzenethiosulfate, triethylthiourea (sulfur sensitizing agent) and a compound-1 (a gold sensitizer) were added thereto, followed by ripening so that chemical sensitization became optimal. Then, 1-(5-methylureidophenyl)-5-mercaptotetrazole, compound-2, a compound containing as a major component a repeating unit 2 or 3 (the terminal groups X1 and X2 being hydroxyl groups), compound-4 and potassium bromide were added thereto to complete chemical sensitization. The thus-obtained emulsion was taken as emulsion BH-1.

sensitizing dye S-1

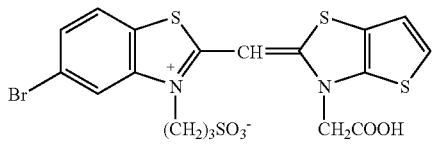

sensitizing dye S-2

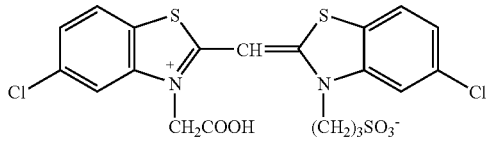

sensitizing dye S-3

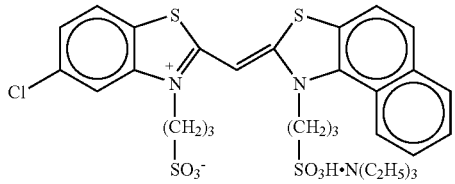

compound-1

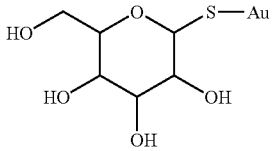

-continued compound-2

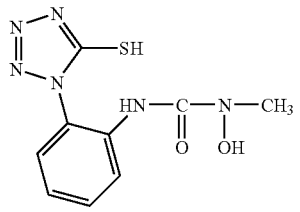

compound-3

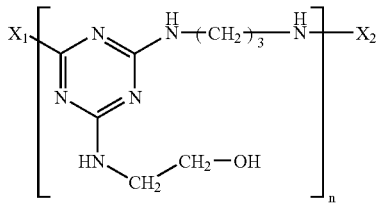

compound-4

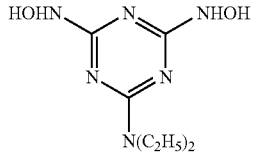

(Preparation of Blue-sensitive Layer Emulsion BL-1)

Emulsion grains were obtained in the same manner as in preparation of the emulsion BH-1 except for changing the temperature and addition rate in the step of simultaneously adding silver nitrate and sodium chloride and changing the amounts of various metal complexes added in the course of addition of silver nitrate and sodium chloride. The emulsion grains were mono-disperse cubic silver iodobromochloride grains of 0.44 μm in side length and 9.5% in coefficient of variation. An emulsion BL-1 was prepared in the same manner as with the emulsion BH-1 except for changing the amounts of various compounds added after re-dispersion of the emulsion.

(Preparation of Green-sensitive Layer Emulsion GH-1)

Cubic grains having a high silver chloride content were prepared by a method of simultaneously adding silver nitrate and sodium chloride to a deionized distilled water containing deionized gelatin under stirring to mix. In the course of this preparation, $K_4[Ru(CN)_6]$ was added over a period of from the point where addition of silver nitrate was 80% to the point where addition of silver nitrate was 90%. Potassium bromide (2 mols % per mol of finished silver halide) was added thereto over a period of from the point where addition of silver nitrate was 80% to the point where addition of silver nitrate was 100%. $K_2[IrCl_6]$ and $K_2[RhBr_5(H_2O)]$ were added over a period of from the point where addition of silver nitrate was 83% to the point where addition of silver nitrate was 88%. At the point where addition of silver nitrate was completed 90%, potassium iodide (0.1 mol % per mol of finished silver halide) was added thereto under vigorous stirring. Further, $K_2[IrCl_5(H_2O)]$ and $K[IrCl_4(H_2O)_2]$ were added thereto over a period of from the point where addition of silver nitrate was 92% to the point where addition of silver nitrate was 98%. The thus-obtained emulsion grains were mono-disperse cubic silver iodobromochloride grains of 0.42 μm in side length and 8.0% in coefficient of variation. This emulsion was subjected to the same desalting treatment by precipitation and to re-dispersing as described hereinbefore.

This emulsion was dissolved at 40° C., sodium benzenethiosulfate, p-glutaramidophenyldisulfide, sodium thiosulfate pentahydrate (sulfur sensitizing agent) and bis(1,4,5-trimethyl-1,2,4-triazolium-3-thiolato)aurate (I) tetrafluoroborate) (a gold sensitizer) were added thereto, followed by ripening so that chemical sensitization became optimal. Then, 1-(3-acetamidophenyl)-5-mercaptotetrazole, 1-(5-methylureidophenyl)-5-mercaptotetrazole, compound-2, compound-4 and potassium bromide were added thereto. Further, in the course of the emulsion-preparing step, a sensitizing dyes S-4, S-5, S-6 and S-7 were added thereto to perform spectral sensitization. The thus-obtained emulsion was taken as an emulsion GH-1.

sensitizing dye S-4

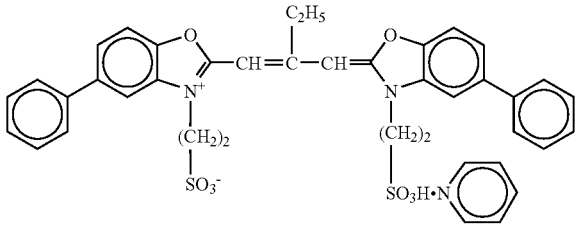

sensitizing dye S-5

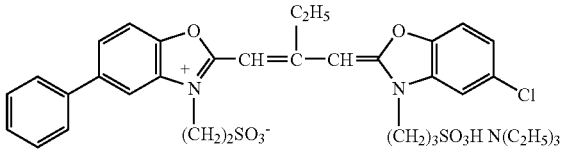

sensitizing dye S-6

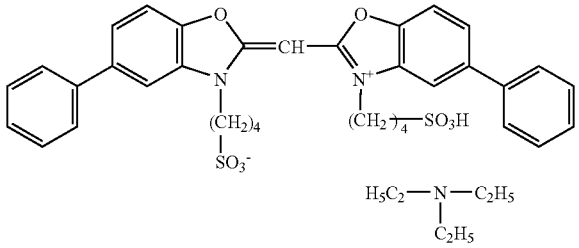

sensitizing dye S-7

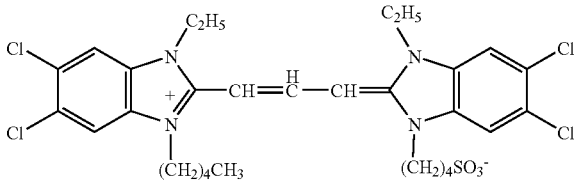

(Preparation of Green-sensitive Layer Emulsion GL-1)

Emulsion grains were obtained in the same manner as in preparation of the emulsion GH-1 except for changing the temperature and addition rate in the step of simultaneously adding silver nitrate and sodium chloride and changing the amounts of various metal complexes added in the course of addition of silver nitrate and sodium chloride. The emulsion grains were mono-disperse cubic silver iodobromochloride grains of 0.35 μm in side length and 9.8% in coefficient of variation. An emulsion GL-1 was prepared in the same manner as with the emulsion GH-1 except for changing the amounts of various compounds added after re-dispersion of the emulsion.

(Preparation of Red-sensitive Layer Emulsion RH-1)

Cubic grains having a high silver chloride content were prepared by a method of simultaneously adding silver nitrate and sodium chloride to a deionized distilled water containing deionized gelatin under stirring to mix. In the course of this preparation, $Cs_2[OsCl_5(NO)]$ was added over a period of from the point where addition of silver nitrate was 60% to the point where addition of silver nitrate was 80%. $K_4[Ru(CN)_6]$ was added over a period of from the point where addition of silver nitrate was 80% to the point where addition of silver nitrate was 90%. Potassium bromide (1.3 mols % per mol of finished silver halide) was added thereto over a period of from the point where addition of silver nitrate was 80% to the point where addition of silver nitrate was 100%. $K_2[IrCl_5(5\text{-methylthiazole})]$ was added over a period of from the point where addition of silver nitrate was 83% to the point where addition of silver nitrate was 88%. At the point where addition of silver nitrate was completed 88%, potassium iodide (0.05 mol % per mol of finished silver halide) was added thereto under vigorous stirring. Further, $K_2[IrCl_5(H_2O)]$ and $K[IrCl_4(H_2O)_2]$ were added thereto over a period of from the point where addition of silver nitrate was 92% to the point where addition of silver nitrate was 98%. The thus-obtained emulsion grains were mono-disperse cubic silver iodobromochloride grains of 0.39 μm in side length and 10% in coefficient of variation. The thus-obtained emulsion was subjected to desalting treatment by precipitation and re-dispersing in the same manner as described hereinbefore.

This emulsion was dissolved at 40° C., and a sensitizing dye S-8, compound-5, triethylthiourea (sulfur sensitizing agent) and a compound-1 (a gold sensitizer) were added thereto, followed by ripening so that chemical sensitization became optimal. Then, 1-(3-acetamidophenyl)-5-mercaptotetrazole, 1-(5-methylureidophenyl)-5-mercaptotetrazole, compound-2, compound-4 and potassium bromide were added thereto. The thus-obtained emulsion was taken as emulsion RH-1.

sensitizing dye S-8

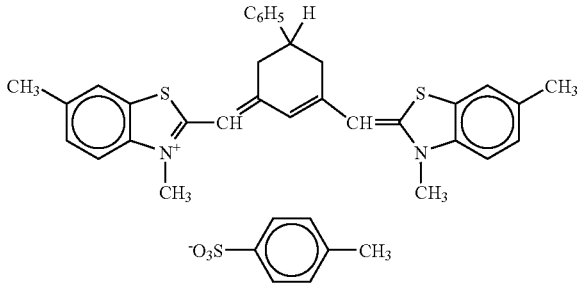

compound-5

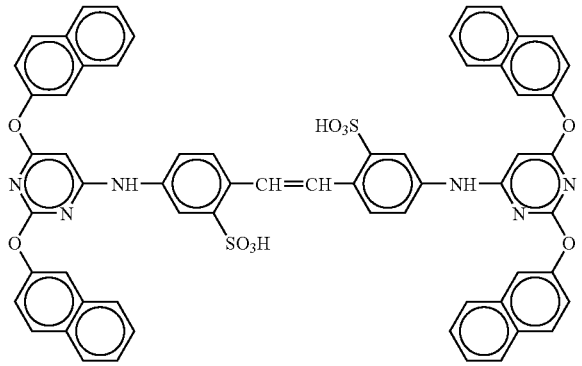

(Preparation of Red-sensitive Layer Emulsion RL-1)

Emulsion grains were obtained in the same manner as in preparation of the emulsion RH-1 except for changing the temperature and addition rate in the step of simultaneously adding silver nitrate and sodium chloride and changing the amounts of various metal complexes added in the course of addition of silver nitrate and sodium chloride. The emulsion grains were mono-disperse cubic silver iodobromochloride grains of 0.29 μm in side length and 9.9% in coefficient of variation. An emulsion RL-1 was prepared in the same manner as with the emulsion RH-1 except for changing the amounts of various compounds added after desalting treatment by precipitation and re-dispersion of the emulsion.

Preparation of a Coating Solution for the First Layer 34 g of a yellow coupler (ExY-1), 1 g of a color image-stabilizing agent (Cpd-1), 1 g of a color image-stabilizing agent (Cpd-2), 8 g of a color image-stabilizing agent (Cpd-8), 1 g of a color image-stabilizing agent (Cpd-18), 2 g of a color image stabilizing agent (Cpd-19), 15 g of a color image stabilizing agent (Cpd-20), 1 g of a color image stabilizing agent (Cpd-21), 15 g of a color image stabilizing agent (Cpd-23), 0.1 g of an additive (ExC-1) and 1 g of a color image stabilizing agent (UV-2) were dissolved in 23 g of a solvent (Solv-4), 4 g of a solvent (Solve-6), 23 g of a solvent (Solv-9) and 60 ml of ethyl acetate, and this solution was emulsified into 270 g of a 20% by mass gelatin aqueous solution containing 4 g of sodium dodecylbenzenesulfonate in a high-speed stirring machine for emulsification (a dissolver). Then, water was added thereto to prepare 900 g of an emulsified dispersion A.

On the other hand, the emulsified dispersion A and the emulsions BH-1 and BL-1 were mixed to dissolve so as to obtain the following formulation, thus a coating solution for the first layer being prepared. The coated amount of the emulsion is shown in terms of the coated amount of silver.

Coating solutions for the second layer to the seventh layer were prepared in the same manner as with the coating solution for the first layer. As a gelatin hardening agent, 1-hydroxy-3,5-dichloro-s-triazine sodium salt (H-1), (H-2) and (H-3) were used. Also, Ab-1, Ab-2 and Ab-3 were added to individual layers in total amounts of 15.0 mg/m$^2$, 60.0 mg/m$^2$, 5.0 mg/m$^2$ and 10.0 mg/m$^2$, respectively.

(H-1) hardening agent

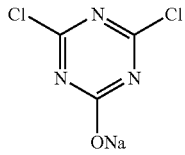

(H-2) hardening agent

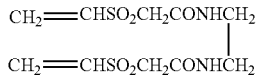

(H-3) hardening agent

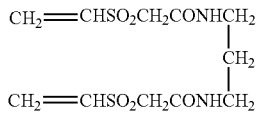

1-(3-Methylureidophenyl)-5-mercaptotetrazole was added to the second layer, the fourth layer and the sixth layer in amounts of 0.2 mg/m$^2$, 0.2 mg/m$^2$ and 0.6 mg/m$^2$, respectively. 4-Hydroxy-6-methyl-1,3,3a,7-tetrazaindene was added to the blue-sensitive emulsion layer and the green-sensitive emulsion layer in amounts of $1\times10^{-4}$ mol and $2\times10^{-4}$ mol, respectively, per mol of silver halide. A latex of a methacrylic acid/butyl acrylate copolymer (weight ratio=1:1; average molecular weight: 200000 to 400000) was added to the red-sensitive emulsion layer in an amount of 0.05 g/m$^2$. Disodium catechol-3,5-disulfonate was added to the second layer, the fourth layer and the sixth layer in amounts of 6 mg/m$^2$, 6 mg/m$^2$ and 18 mg/m$^2$, respectively. Sodium polystyrenesulfonate was added to each layer, as needed, to adjust viscosity of the coating solution. In order to prevent irradiation, following dyes (numerals within parentheses representing coated amounts) were added.

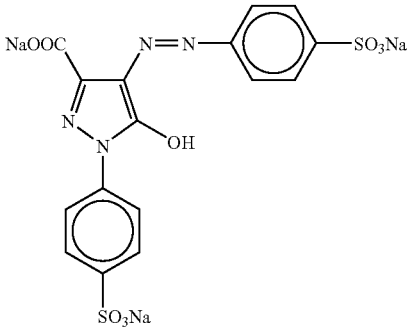

(2 mg/m$^2$)

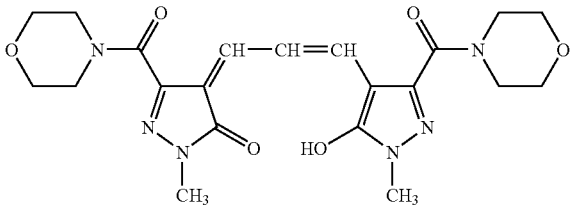

(2 mg/m$^2$)

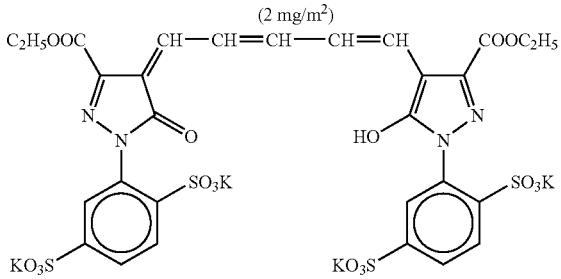

(24 mg/m$^2$)

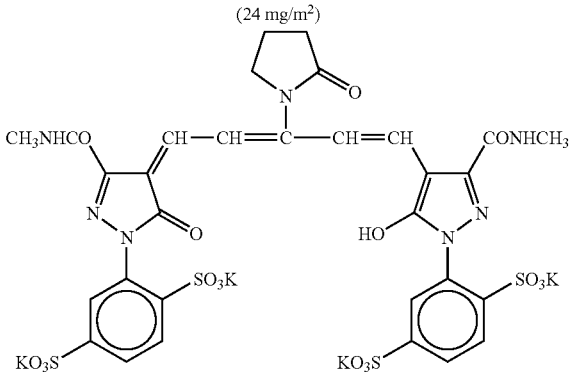

(3 mg/m$^2$)

(Layer Structure)

Structure of each layer is shown below. Numerals indicate coated amounts (g/m$^2$). The amount of silver halide emulsion is represented in terms of the coated amount of silver.

Support

Polyethylene Resin-laminated Paper

[Polyethylene resin on the first layer side contains a white pigment (content of TiO2: 16% by weight; content of ZnO: 4% by weight), a fluorescent brightening agent (4,4'-bis(5-methylbenzoxazolyl)stilbene (content: 0.03% by weight) and a bluing dye (ultramarine; content: 0.33% by weight). The amount of polyethylene resin is 29.2 g/m$^2$.)

| | |
|---|---|
| First layer (blue-sensitive emulsion layer) | |
| Emulsion (mixture of BH-1 and BL-1; 5:5 in molar ratio of silver) | 0.16 |
| Gelatin | 1.32 |
| Yellow coupler (EX-Y) | 0.34 |
| Color image stabilizing agent (Cpd-1) | 0.01 |
| Color image stabilizing agent (Cpd-2) | 0.01 |
| Color image stabilizing agent (Cpd-8) | 0.08 |
| Color image stabilizing agent (Cpd-18) | 0.01 |
| Color image stabilizing agent (Cpd-19) | 0.02 |
| Color image stabilizing agent (Cpd-20) | 0.15 |
| Color image stabilizing agent (Cpd-21) | 0.01 |
| Color image stabilizing agent (Cpd-23) | 0.15 |
| Additive (ExC-1) | 0.001 |
| Color image stabilizing agent (UV-A) | 0.01 |
| Solvent (Solv-4) | 0.23 |
| Solvent (Solv-6) | 0.04 |
| Solvent (Solv-9) | 0.23 |
| Second layer (color mixing-preventing layer) | |
| Gelatin | 0.78 |
| Color mixing-preventing agent (Cpd-4) | 0.05 |
| Color mixing-preventing agent (Cpd-12) | 0.01 |
| Color image stabili9zing agent (Cpd-5) | 0.006 |
| Color image stabilizing agent (Cpd-6) | 0.05 |
| Color image stabilizing agent (UV-A) | 0.06 |
| Color image stabilizing agent (Cpd-7) | 0.006 |
| Antiseptic (Cpd-24) | 0.006 |
| Solvent (Solv-1) | 0.06 |
| Solvent (Solv-2) | 0.06 |
| Solvent (Solv-5) | 0.07 |
| Solvent (Solv-8) | 0.07 |
| Third layer (green-sensitive emulsion layer) | |
| Emulsion (mixture of GH-1 and GL-1; 1:3 in molar ratio of silver) | 0.12 |
| Gelatin | 0.95 |
| Magenta coupler (ExM) | 0.12 |
| UV ray absorbent (UV-A) | 0.03 |
| Color image stabilizing agent (Cpd-2) | 0.01 |
| Color image stabilizing agent (Cpd-6) | 0.08 |
| Color image stabilizing agent (Cpd-7) | 0.005 |
| Color image stabilizing agent (Cpd-8) | 0.01 |
| Color image stabilizing agent (Cpd-9) | 0.01 |
| Color image stabilizing agent (Cpd-10) | 0.005 |
| Color image stabilizing agent (Cpd-11) | 0.0001 |
| Color image stabilizing agent (Cpd-20) | 0.01 |
| Solvent (Solv-3) | 0.06 |
| Solvent (Solv-4) | 0.12 |
| Solvent (Solv-6) | 0.05 |
| Solvent (Solv-9) | 0.16 |
| Fourth layer (color mixing-preventing layer) | |
| Gelatin | 0.65 |
| Color mixing-preventing agent (Cpd-4) | 0.04 |
| Color mixing-preventing agent (Cpd-12) | 0.01 |
| Color image stabili9zing agent (Cpd-5) | 0.005 |
| Color image stabilizing agent (Cpd-6) | 0.04 |
| Color image stabilizing agent (UV-A) | 0.05 |
| Color image stabilizing agent (Cpd-7) | 0.005 |
| Antiseptic (Cpd-24) | 0.005 |
| Solvent (Solv-1) | 0.05 |
| Solvent (Solv-2) | 0.05 |
| Solvent (Solv-5) | 0.06 |
| Solvent (Solv-8) | 0.06 |

-continued

| | |
|---|---|
| Fifth layer (red-sensitive emulsion layer) | |
| Emulsion (mixture of RH-1 and RL-1; 4:6 in molar ratio of silver) | 0.10 |
| Gelatin | 1.11 |
| Cyan coupler (ExC-1) | 0.11 |
| Cyan coupler (ExC-2) | 0.01 |
| Cyan coupler (ExC-3) | 0.04 |
| Color image stabilizing agent (Cpd-1) | 0.03 |
| Color image stabilizing agent (Cpd-7) | 0.01 |
| Color image stabilizing agent (Cpd-9) | 0.04 |
| Color image stabilizing agent (Cpd-10) | 0.001 |
| Color image stabilizing agent (Cpd-14) | 0.001 |
| Color image stabilizing agent (Cpd-15) | 0.18 |
| Color image stabilizing agent (Cpd-16) | 0.002 |
| Color image stabilizing agent (Cpd-17) | 0.001 |
| Color image stabilizing agent (Cpd-18) | 0.05 |
| Color image stabilizing agent (Cpd-19) | 0.04 |
| Color image stabilizing agent (UV-5) | 0.10 |
| Solvent (Solv-5) | 0.19 |
| Sixth layer (UV ray-absorbing layer) | |
| Gelatin | 0.34 |
| UV ray absorbent (UV-B) | 0.24 |
| Compound (S1-4) | 0.0015 |
| Solvent (Solv-7) | 0.11 |
| Seventh layer (protective layer) | |
| Gelatin | 0.82 |
| Additive (Cpd-22) | 0.03 |
| Liquid paraffin | 0.02 |
| Surfactant (Cpd-13) | 0.02 |

(Ex-Y)

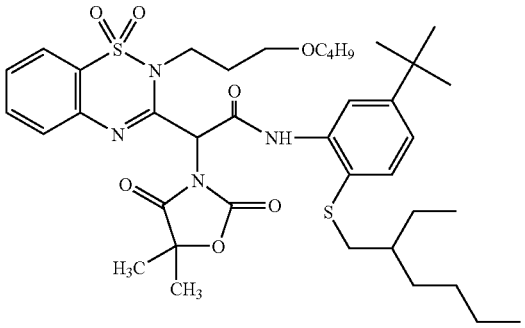

(ExM) Magenta Coupler

A mixture of

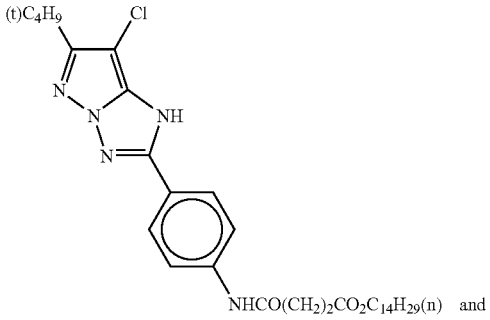

and

-continued

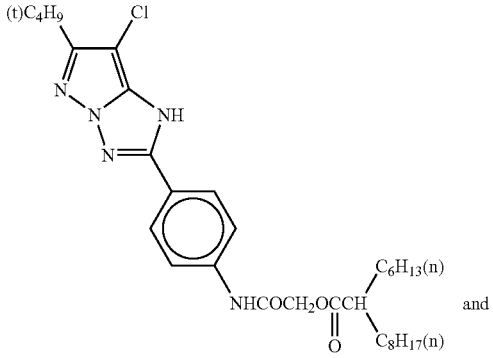

and

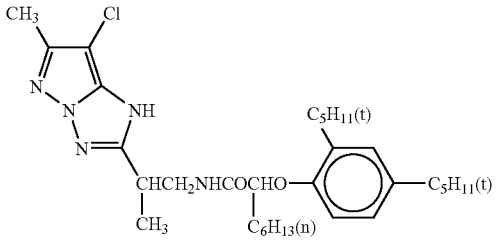

with a mixing ratio of 40:40:20 (molar ratio)

(ExC-1) cyan coupler

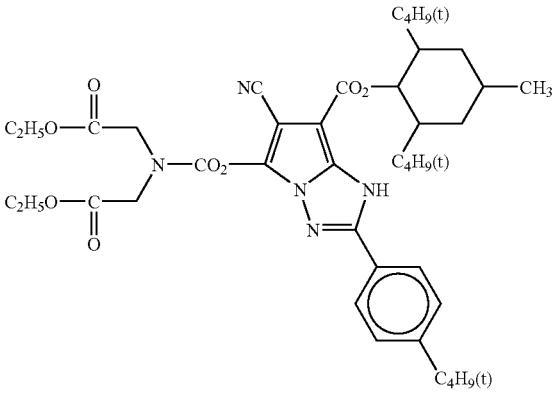

(ExC-2) cyan coupler

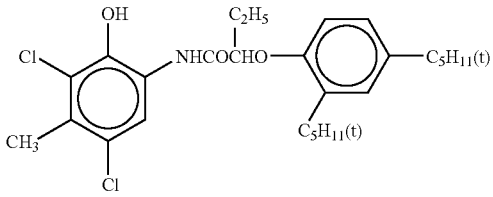

(ExC-3) cyan coupler

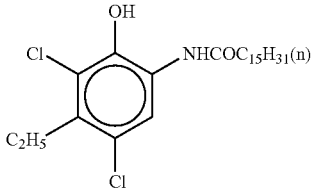

-continued (Cpd-1) color image stabilizing agent

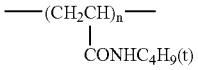

number-average molecular weight 60,000

(Cpd-2) color image stabilizing agent

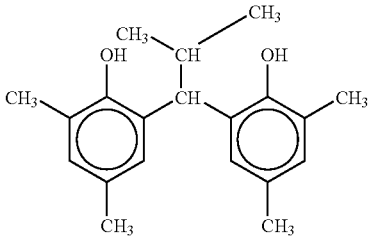

(Cpd-3) color image stabilizing agent

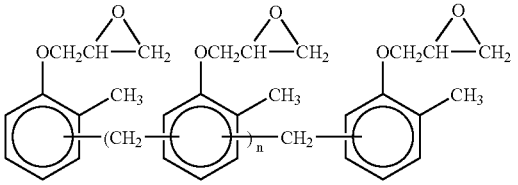

n = 7 to 8 (average value)

(Cpd-4) color mixing-preventing agent

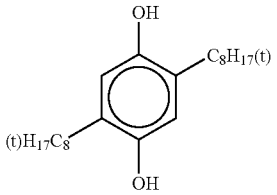

(Cpd-5) color image stabilizing agent

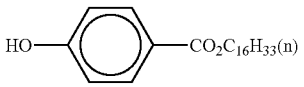

(Cpd-6) color image stabilizing agent

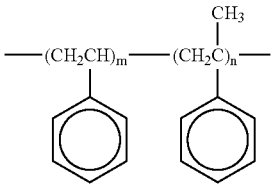

number-average molecular weight 600
m/n=10/90

(Cpd-7) color image stabilizing agent

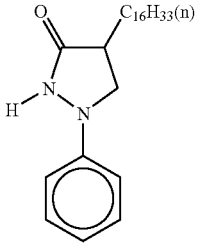

-continued (Cpd-8) color image stabilizing agent

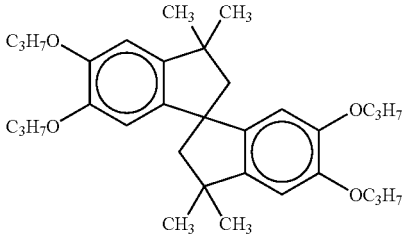

(Cpd-9) color image stabilizing agent

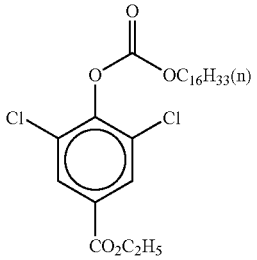

(Cpd-10) color image stabilizing agent

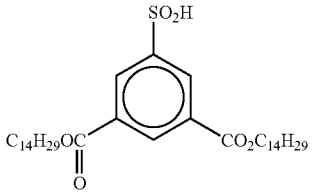

(Cpd-11)

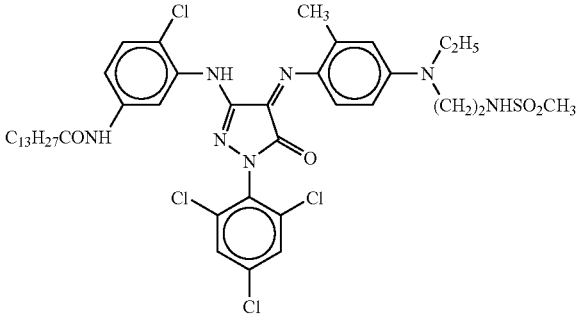

(Cpd-12)

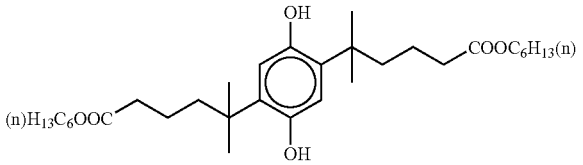

(Cpd-13) surfactant

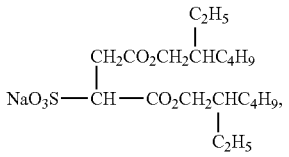

(a)

-continued
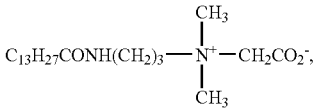
(b)
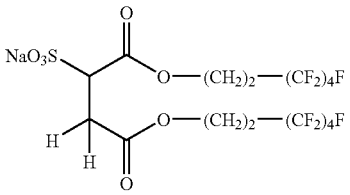
(c)
(a)/(b)/(C) mixture with a mixing ratio of 6:2:2 (molar ratio)
(Cpd-14)
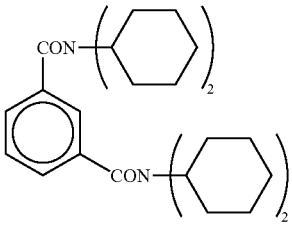
(Cpd-15)
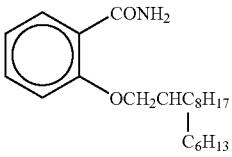
(Cpd-16)
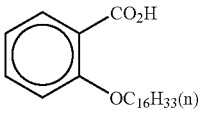
(Cpd-17)
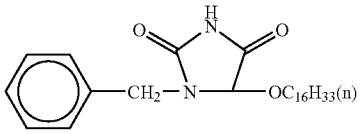
(Cpd-18)
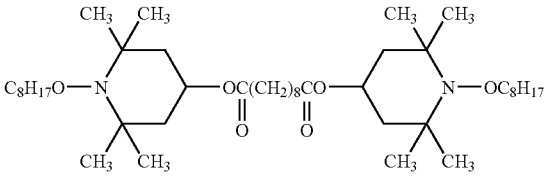
(Cpd-19)
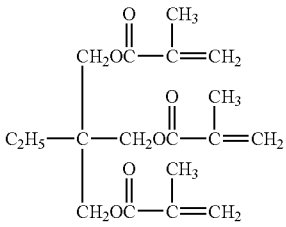
-continued
(Cpd-20)
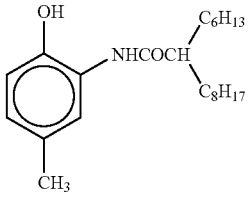
(Cpd-21)
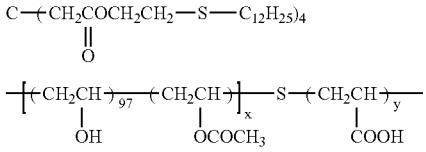
x:y = 5:1 (by mass)
KAYARAD DPCA-30 manufactured by Nippon Kayaku
(Cpd-24)
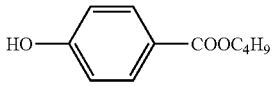
(Solv-1)
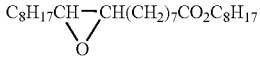
(Solv-2)
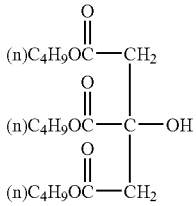
(Solv-3)
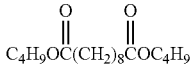
(Solv-4)
(Solv-5)
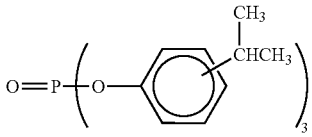
(Solv-6)
(Solv-7)
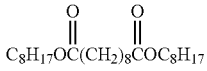
(Solv-8)
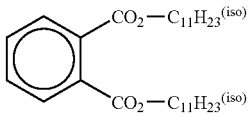
(Solv-9)
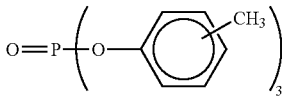

-continued (S1-4)

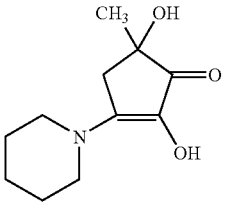

(UV-1) UV ray absorbent

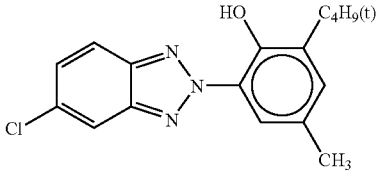

(UV-2) UV ray absorbent

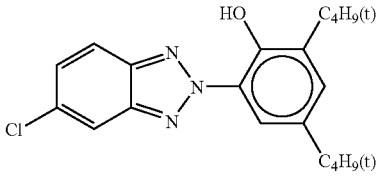

(UV-3) UV ray absorbent

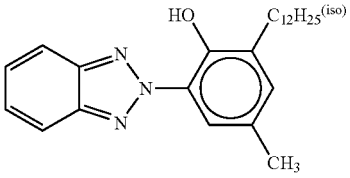

(UV-4) UV ray absorbent

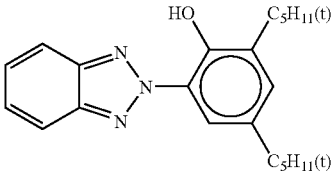

-continued (UV-5) UV ray absorbent

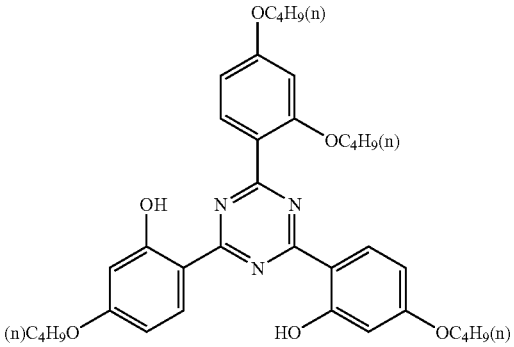

UV-A: mixture of UV-1/UV-4/UV-5=1/7/2 (by mass)

UV-B: mixture of UV-1/UV-3/UV-4/UV-5=1/3/5/1 (by mass)

The thus-prepared sample was taken as sample 001.

2. Development Processing Test

The above-described sample 001 was worked into a roll of 127 mm in width, and was exposed to a standard photographic image using Digital Minilab Frontier 340 (manufactured by Fuji Photo Film Co., Ltd.). Subsequently, continuous processing (running test) was conducted according to the following processing steps till the volume of a replenisher for color development reached two times as much as the volume of the color-developing tank, provided that Frontier 340 was modified so that the conveying speed in the processor realized the following processing time and that the tank structure became as shown in FIG. 1.

| Processing Step | Temp. | Time | Replenished Amount |
|---|---|---|---|
| Color development | 45.0° C. | 12 sec | 30 mL |
| Bleaching | 45.0° C. | 5 sec | 10 mL |
| Fixing | 40.0° C. | 3 sec | 10 mL |
| Rinse 1 | 45.0° C. | 3 sec | — |
| Rinse 2 | 45.0° C. | 3 sec | — |
| Rinse 3 | 45.0° C. | 1.5 sec | — |
| Rinse 4 | 45.0° C. | 1.5 sec | — |
| Rinse 5 | 45.0° C. | 1.5 sec | — |
| Rinse 6 | 45.0° C. | 1.5 sec | 80 mL |
| Drying | 80° C. | | |

(Notes)

* replenished amount per $m^2$ of light-sensitive material

•* Rinsing was performed in a 4-tank countercurrent system of from (1) to (6).

Formulation of each processing solution is as follows.

| [Color developer] | [Tank solution] | [Replenisher] |
|---|---|---|
| Water | 800 mL | 800 mL |
| Fluorescent brightening agent (FL-1) | 4.0 g | 9.0 g |
| Residual color reducing agent (SR-1) | 3.0 g | 8.0 g |
| Sodium p-toluene-sulfonate | 10.0 g | 10.0 g |
| Ethylenediaminetetra-acetic acid | 4.0 g | 4.0 g |
| Sodium sulfite | 0.10 g | 0.10 g |
| Potassium chloride | 10.0 g | — |
| Sodium 4,5-dihydroxy-benzene-1,3-disulfonate | 0.50 g | 0.50 g |

-continued

| | | |
|---|---|---|
| disodium-N,N-bis-(sulfonatoethyl)-hydroxylamine | 8.5 g | 14.0 g |
| 4-Amino-3-methyl-N-ethyl-N-(β-methane-sulfonamidoethyl)aniline 3/2 sulfate monohydrate | 7.0 g | 17.5 g |
| Potassium carbonate | 26.3 g | 26.3 g |
| Water to make | 1000 mL | 1000 mL |
| pH (25° C.; adjusted with sulfuric acid and KOH) | 10.25 | 13.0 |

| [Bleaching solution] | [Tank solution] | [Replenisher] |
|---|---|---|
| Water | 800 mL | 600 mL |
| Organic acid (see Table 1) | 0.10 mol | 0.35 mol |
| Fe(III) ammonium ethylene-diaminetetraacetate | 47.0 g | 164.5 g |
| Ethylenediaminetetraacetic acid | 1.4 g | 4.9 g |
| Nitric acid (67%) | 17.5 g | 61.3 g |
| Compound of general formula (1) (see Table 1) | 0.05 mol | 0.20 mol |
| Ammonium bromide | 50.0 g | 150.0 g |
| Water to make | 1000 mL | 1000 mL |
| pH (25° C.; adjusted with nitric acid and aqueous ammonia) | 5.00 | 2.00 |

| [Fixing solution] | [Tank solution] | [Replenisher] |
|---|---|---|
| Water | 800 mL | 600 mL |
| Ammonium thiosulfate (70%) | 0.3 mol | 1.05 mol |
| Ethylenediaminetetra-acetic acid | 1.4 g | 4.9 g |
| Ammonium sulfite | 40.0 g | 140.0 g |
| Water to make | 1000 mL | 1000 mL |
| pH (25° C.; adjusted with nitric acid and aqueous ammonia) | 6.00 | 6.50 |

| [Replenisher] | [Rinse solution] | [Tank solution] |
|---|---|---|
| Sodium chlorinated-isocyanurate | 0.02 g | 0.02 g |
| Deionized water (conductivity: 5 μs/cm or less) | 1000 mL | 1000 mL |
| pH (25° C.) | 6.5 | 6.5 |

FL-1

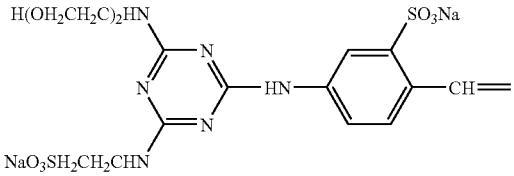

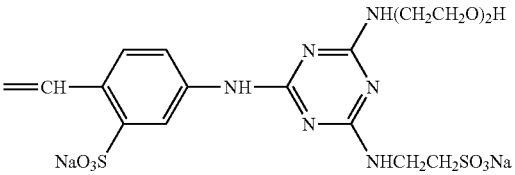

SR-1

-continued

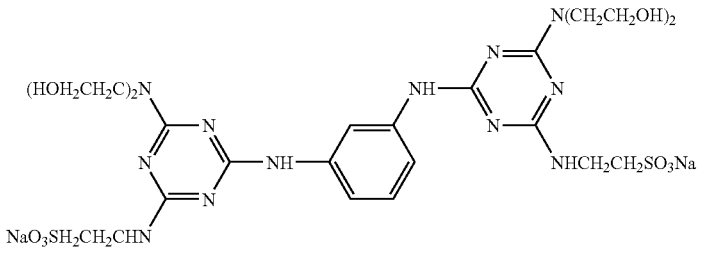

For comparison, continuous processing was conducted in the same manner using Frontier 340 (manufactured by Fuji Photo Film Co., Ltd.), provided that Frontier 340 (manufactured by Fuji Photo Film Co., Ltd.) was modified so that the conveying speed in the processor and the tank structure realized the following processing time.

| Processing Step | Temp. | Time | Replenished Amount |
|---|---|---|---|
| Color development | 45.0° C. | 12 sec | 30 mL |
| Bleach-fixing | 45.0° C. | 8 sec | 10 mL for bleaching part; 10 mL for fixing part |
| Rinse 1 | 45.0° C. | 3 sec | — |
| Rinse 2 | 45.0° C. | 3 sec | — |
| Rinse 3 | 45.0° C. | 3 sec | — |
| Rinse 4 | 45.0° C. | 3 sec | 175 mL |
| Drying | 80° C. | | |

(Notes)

* replenished amount per $m^2$ of light-sensitive material

•* Rinsing was performed in a 4-tank countercurrent system of from (1) to (4).

Formulation of each processing solution is as follows.

| [Color developer] | [Tank solution] | [Replenisher] |
|---|---|---|
| | Same as in Example of the invention described above | Same as in Example of the invention described above |

| [Bleach-fixing tank solution] | |
|---|---|
| Water | 600 mL |
| Citric acid | 19.2 g |
| Sulfosuccinic acid | 19.4 g |
| Fe(III) ammonium ethylene-diaminetetraacetate | 47.0 g |
| Ethylenediaminetetraacetic acid | 2.8 g |
| Nitric acid (67%) | 17.5 g |
| m-Carboxysulfinic acid | 9.3 g |
| Ammonium bromide | 50.0 g |
| Ammonium thiosulfate (70%) | 0.3 mol |
| Ammonium sulfite | 40.0 g |
| Water to make | 1000 mL |
| pH (25° C.; adjusted with nitric acid and aqueous ammonia) | 6.00 |

-continued

| [Bleach-fixing replenisher] | [Bleaching part] | [Fixing part] |
|---|---|---|
| | Same as the bleaching replenisher described hereinbefore | Same as the fixing replenisher described hereinbefore |
| [Rinse solution] | [Tank solution] | [Replenisher] |
| | Same as described hereinbefore | Same as described hereinbefore |

Upon completion of the above-described continuous processing, processed color papers were subjected to the following measurements. The results are shown in Table 1.

Amount of residual silver: The amount of residual silver in black portion of processed paper was measured according to fluorescent X-ray analysis.

Stain: The blue light reflection density in white background (reflection density for Status A Blue light) was measured.

Amount of residual developing agent: The amount of the developing agent remaining in color paper was measured by extracting the developing agent and analyzing by the color-forming method.

Stain with time: The increased yellow density of white background after leaving it for 2 days in an environment of 80° C./70% RH (an increased portion of reflection density for Status A Blue light) was measured.

Processing stability: It was visually judged whether a precipitate was formed or not in a bleach running solution (whether a residue remained or not on a micro-filter of 10 μm in pore size when the processing solution was filtered through it).

Storage stability of bleaching composition: It was visually judged whether a precipitate was formed or not in a concentrated bleaching solution (a 1.5-times concentrated solution of the bleaching replenisher) after leaving it for 2 weeks at −5° C.

Results are shown in Table 1.

TABLE 1

| | Experiment No. | | | | |
|---|---|---|---|---|---|
| | No. 1 | No. 2 | No. 3 | No. 4 | No. 5 |
| Processor | Bleach-fixing step | Bleaching step + Fixing step | Bleaching step + Fixing step | Bleaching step + Fixing step | Bleaching step + Fixing step |
| Compound of formula (I) in bleaching solution | | not added | m-carboxy-sulfinic acid | m-carboxy-sulfinic acid | m-carboxy-sulfinic acid |
| Organic acid in bleaching solution | | succinic acid | succinic acid | citric acid | sulfo-succinic acid |
| Note | Comparative Example | Comparative Example | Present Invention | Present Invention | Present Invention |
| 1) Amount of residual silver ($\mu g/cm^2$) | 5.0 | 0.3 | 0.3 | 0.3 | 0.3 |
| 2) Minumum yellow density | 0.090 | 0.090 | 0.055 | 0.055 | 0.055 |
| 3) Amount of residual developing agent ($\mu mol/m^2$) | 20 | 10 | 4 | 2 | 2 |
| 4) Increased density of minimum yellow density after leaving for 2 days at 80° C./70% | 0.031 | 0.020 | 0.010 | 0.007 | 0.007 |
| 5) Precipitation of bleach running solution | No precipitation | Much amount of precipitate | No precipitation | No precipitation | No precipitation |
| 6) Precipitation of concentrated bleaching solution after leaving for 2 weeks at −5° C. | Slight amount of precipitate | Slight amount of precipitate | Slight amount of precipitate | No precipitation | No precipitation |

In Table 1, Experiment No. 2, which is a comparative example, the minimum yellow density is high, and a precipitate is formed in the bleach running solution, though the amount of residual silver in the black portion of processed color paper. Also, the concentration of the residual developing agent is high, which causes a large increase in the yellow density after leaving at 80° C./70%.

Experiment Nos. 3 to 5 employing the processing composition and the processing steps of the invention showed a low amount of residual silver, a low minimum yellow density, a low concentration of the residual developing agent and a small increase in yellow density after leaving at 80° C./70%. Thus, there was obtained the result that good photographic properties in spite of rapid processing steps.

Of the invention, Experiment Nos. 4 and 5 wherein the bleaching solution contained tribasic acid provided particularly preferred results in the points of precipitation of the concentrated bleaching solution at a low temperature and residual developing agent.

What is claimed is:

1. A concentrated processing solution for silver halide color paper, which comprises as constituting parts:

a concentrated processing composition for bleach replenishment; and a concentrated processing composition for a replenisher having fixing ability, wherein the concentrated processing composition for bleach replenishment and the concentrated processing composition for a replenisher having fixing ability comprise at least the following constituents respectively, and the concentrated processing solution is for use in a processing comprising steps of treatment in a color developer, subsequent treatment in a bleaching solution and subsequent treatment in a solution having fixing ability:

| Concentrated processing composition for bleach replenishment | |
|---|---|
| EDTA•Fe(III)•ammonium | 0.3 mol/L or more |
| Sulfinic acid compound represented by formula (I) | 0.01 mol/L or more |
| Ammonium bromide | 0.5 mol/L or more |
| pH | 3.0 or less |

$RSO_2M$ Formula (I)

wherein R represents an alkyl group, a cycloalkyl group, an alkenyl group, an alkynyl group, an aralkyl group, an aryl group or a hetero ring group; and M represents a hydrogen atom, an alkali metal atom, an ammonio group or a quaternary amino group; and Concentrated processing composition for a replenisher having fixing ability

| | |
|---|---|
| Ammonium thiosulfate | 0.7 mol/L or more |
| Ammonium sulfite | 0.4 mol/L or more |
| pH | 4.0 or more. |

2. The concentrated processing composition for silver halide color paper according to claim 1, wherein the concentrated processing composition for bleach replenishment comprises a tribasic acid.

3. The concentrated processing composition for silver halide color paper according to claim 2, wherein the concentrated processing composition for bleach replenishment comprises at least one of citric acid and/or sulfosuccinic acid as the tribasic acid.

4. The concentrated processing composition for silver halide color paper according to claim 1, which further comprises as a constituting part a concentrated processing composition for color-developing replenisher comprising 2-methyl-4-[N-ethyl-N-(β-methylsulfoamidoethyl)amino] aniline or a salt thereof.

5. A method for processing silver halide color paper, which comprises processing steps comprising:

a step of treatment in a color developer;

a subsequent step of treatment in a bleaching solution; and a subsequent step of treatment in a solution having fixing ability, wherein a light-sensitive material is conveyed in a solution without being in tough with an air between the treatment in the bleaching solution and the treatment in the solution having fixing ability, sum of the processing time of the treatment in the bleaching solution and the treatment in the solution having fixing ability is 12 seconds or shorter, and the treatments are continuously conducted using the concentrated processing composition for silver halide color paper according to claim 1.

6. The method for processing silver halide color paper according to claim 5, wherein a bleaching replenisher to replenish a bleaching tank and a fixative replenisher to replenish a processing tank for a solution having fixing ability are replenishers prepared from the concentrated processing composition for silver halide color paper and sum of amounts of individual replenishers is 35 mL or less per $m^2$ of color paper.

* * * * *